US011952648B2

(12) United States Patent
Valdez et al.

(10) Patent No.: US 11,952,648 B2
(45) Date of Patent: Apr. 9, 2024

(54) METHOD OF FORMING AND HEAT TREATING COILED TUBING

(71) Applicant: TENARIS COILED TUBES, LLC, Houston, TX (US)

(72) Inventors: Martin Valdez, Buenos Aires (AR); Bruce A. Reichert, Houston, TX (US); Jorge Mitre, Houston, TX (US)

(73) Assignee: Tenaris Coiled Tubes, LLC, Houston, TX (US)

( * ) Notice: Subject to any disclaimer, the term of this patent is extended or adjusted under 35 U.S.C. 154(b) by 246 days.

(21) Appl. No.: 16/685,333

(22) Filed: Nov. 15, 2019

(65) Prior Publication Data

US 2020/0102633 A1 Apr. 2, 2020

Related U.S. Application Data

(60) Continuation of application No. 14/872,490, filed on Oct. 1, 2015, now Pat. No. 10,480,054, which is a division of application No. 13/229,517, filed on Sep. 9, 2011, now Pat. No. 9,163,296.

(60) Provisional application No. 61/436,156, filed on Jan. 25, 2011.

(51) Int. Cl.

| | |
|---|---|
| ***C21D 9/10*** | (2006.01) |
| ***C21D 6/00*** | (2006.01) |
| ***C21D 8/10*** | (2006.01) |
| ***C21D 9/08*** | (2006.01) |
| ***C21D 9/14*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***E21B 17/20*** | (2006.01) |

(52) U.S. Cl.

CPC ..... *C22C 38/38* (2013.01); *C21D 6/002* (2013.01); *C21D 6/005* (2013.01); *C21D 6/008* (2013.01); *C21D 8/105* (2013.01); *C21D 9/08* (2013.01); *C21D 9/085* (2013.01); *C21D 9/14* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *E21B 17/20* (2013.01)

(58) Field of Classification Search

CPC ..... C21D 6/002; C21D 6/005; C21D 6/008; C21D 8/105; C21D 9/08; C21D 9/085; C21D 9/14; C22C 38/02; C22C 38/04; C22C 38/06; C22C 38/26; C22C 38/28; C22C 38/32; C22C 38/38; E21B 17/20

See application file for complete search history.

(56) References Cited

U.S. PATENT DOCUMENTS

| | | | |
|---|---|---|---|
| 3,316,395 | A | 4/1967 | Lavin |
| 3,316,396 | A | 4/1967 | Lavin |
| 3,325,174 | A | 6/1967 | Weaver |
| 3,362,731 | A | 1/1968 | Gasche et al. |
| 3,366,392 | A | 1/1968 | Kennel |
| 3,413,166 | A | 11/1968 | Zackay et al. |
| 3,489,437 | A | 1/1970 | Duret |
| 3,512,789 | A | 5/1970 | Tanner |
| 3,552,781 | A | 1/1971 | Helland |
| 3,572,777 | A | 3/1971 | Blose et al. |
| 3,575,430 | A | 4/1971 | Alpine |
| 3,592,491 | A | 7/1971 | Glover |
| 3,599,931 | A | 8/1971 | Hanson |
| 3,655,465 | A | 4/1972 | Snape et al. |
| 3,733,093 | A | 5/1973 | Seiler |
| 3,810,793 | A | 5/1974 | Heller |
| 3,854,760 | A | 12/1974 | Duret |
| 3,889,989 | A | 6/1975 | Legris et al. |
| 3,891,224 | A | 6/1975 | Ditcher |
| 3,893,919 | A | 7/1975 | Flegel et al. |
| 3,915,697 | A | 10/1975 | Giuliani et al. |
| 3,918,726 | A | 11/1975 | Kramer |
| 3,986,731 | A | 10/1976 | De Hoff |
| 4,014,568 | A | 3/1977 | Carter et al. |
| 4,147,368 | A | 4/1979 | Baker et al. |

(Continued)

FOREIGN PATENT DOCUMENTS

| | | |
|---|---|---|
| AR | 0050159 | 10/2006 |
| AT | 388791 B | 8/1989 |

(Continued)

OTHER PUBLICATIONS

US SDTX; Civil Action No. 4:17-CV-03299 *Global Tubing LLC* vs. *Tenaris Coiled Tubes LLC, et al*; Order, Mar. 20, 2023.

Thompson et al., "Full Body Quenched and Tempered Coiled Tubing—Theory vs. Field Experience," Presented at the Second (Continued)

*Primary Examiner* — Jenny R Wu

(74) *Attorney, Agent, or Firm* — Morgan, Lewis & Bockius LLP

(57) ABSTRACT

Described herein are coiled tubes with improved and varying properties along the length that are produced by using a continuous and dynamic heat treatment process (CDHT). Coiled tubes can be uncoiled from a spool, subjected to a CDHT process, and coiled onto a spool. A CDHT process can produce a "composite" tube such that properties of the tube along the length of the tube are selectively varied. For example, the properties of the tube can be selectively tailored along the length of the tube for particular application for which the tube will be used.

44 Claims, 6 Drawing Sheets

(56) References Cited

U.S. PATENT DOCUMENTS 4,163,290 A 7/1979 Sutherlin et al.
4,219,204 A 8/1980 Pippert
4,231,555 A 11/1980 Saito
4,299,412 A 11/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Smith
4,564,392 A 1/1986 Ohhashi et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A * 12/1986 Dubois ..... E21B 17/20
138/155
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis
5,348,350 A 9/1994 Blose et al.
5,352,406 A 10/1994 Barteri et al.
5,360,239 A 11/1994 Klementich
5,449,420 A 9/1995 Okada et al.
5,454,883 A 10/1995 Yoshie et al.
5,456,405 A 10/1995 Stagg
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Jarvenkyla
5,712,706 A 1/1998 Castore et al.
5,794,985 A 8/1998 Mallis
5,810,401 A 9/1998 Mosing et al.
5,860,680 A 1/1999 Drijver et al.
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowksi
6,045,165 A 4/2000 Sugino et al.
6,056,324 A 5/2000 Reimert et al.
6,070,912 A 6/2000 Latham
6,173,968 B1 1/2001 Nelson et al.
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,257,056 B1 7/2001 Shibayama
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,358,336 B1 3/2002 Miyata
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Marotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.
7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 Lopez et al.
7,753,416 B2 7/2010 Mazzaferro et al.
7,862,667 B2 1/2011 Turconi et al.
8,002,910 B2 8/2011 Tivelli et al.
8,007,601 B2 8/2011 Lopez et al.

(56) References Cited

U.S. PATENT DOCUMENTS

| | | | |
|---|---|---|---|
| 8,007,603 | B2 | 8/2011 | Garcia et al. |
| 8,016,362 | B2 | 9/2011 | Itoga |
| 8,262,094 | B2 | 9/2012 | Beele |
| 8,262,140 | B2 | 9/2012 | Santi et al. |
| 8,317,946 | B2 | 11/2012 | Arai et al. |
| 8,328,958 | B2 | 12/2012 | Turconi et al. |
| 8,328,960 | B2 | 12/2012 | Gomez et al. |
| 8,333,409 | B2 | 12/2012 | Santi et al. |
| 8,414,715 | B2 | 4/2013 | Altschuler et al. |
| 8,544,304 | B2 | 10/2013 | Santi |
| 8,821,653 | B2 | 9/2014 | Anelli et al. |
| 8,840,152 | B2 | 9/2014 | Carcagno et al. |
| 8,926,771 | B2 | 1/2015 | Agazzi |
| 9,004,544 | B2 | 4/2015 | Carcagno et al. |
| 9,163,296 | B2 | 10/2015 | Valdez et al. |
| 9,187,811 | B2 | 11/2015 | Gomez et al. |
| 9,222,156 | B2 | 12/2015 | Altschuler et al. |
| 9,234,612 | B2 | 1/2016 | Santi et al. |
| 9,340,847 | B2 | 5/2016 | Altschuler et al. |
| 9,383,045 | B2 | 7/2016 | Santi et al. |
| 9,598,746 | B2 | 3/2017 | Anellie et al. |
| 9,708,681 | B2 | 7/2017 | Eguchi et al. |
| 9,745,640 | B2 | 8/2017 | Valdez et al. |
| 9,803,256 | B2 | 10/2017 | Valdez et al. |
| 10,378,074 | B2 | 8/2019 | Valdez et al. |
| 10,378,075 | B2 | 8/2019 | Valdez et al. |
| 10,480,054 | B2 | 11/2019 | Valdez et al. |
| 2001/0035235 | A1 | 11/2001 | Kawano |
| 2002/0011284 | A1 | 1/2002 | Von Hagen et al. |
| 2002/0153671 | A1 | 10/2002 | Raymond et al. |
| 2002/0158469 | A1 | 10/2002 | Mannella et al. |
| 2003/0019549 | A1 | 1/2003 | Turconi et al. |
| 2003/0111146 | A1 | 6/2003 | Kusinski et al. |
| 2003/0116238 | A1 | 6/2003 | Fujita |
| 2003/0155052 | A1 | 8/2003 | Kondo et al. |
| 2003/0165098 | A1 | 9/2003 | Ohara et al. |
| 2003/0168859 | A1 | 9/2003 | Watts |
| 2004/0118490 | A1 | 6/2004 | Klueh et al. |
| 2004/0118569 | A1 | 6/2004 | Brill et al. |
| 2004/0131876 | A1 | 7/2004 | Ohgami et al. |
| 2004/0139780 | A1 | 7/2004 | Cai et al. |
| 2004/0187971 | A1 | 9/2004 | Omura |
| 2004/0195835 | A1 | 10/2004 | Noel et al. |
| 2004/0262919 | A1 | 12/2004 | Dutilleul et al. |
| 2005/0012278 | A1 | 1/2005 | Delange |
| 2005/0076975 | A1 | 4/2005 | Lopez et al. |
| 2005/0087269 | A1 | 4/2005 | Merwin |
| 2005/0093250 | A1 | 5/2005 | Santi et al. |
| 2005/0166986 | A1 | 8/2005 | Dell'erba et al. |
| 2006/0006600 | A1 | 1/2006 | Roussie |
| 2006/0124211 | A1 | 6/2006 | Takano et al. |
| 2006/0137781 | A1 | 6/2006 | Kusinski et al. |
| 2006/0157539 | A1* | 7/2006 | DuBois ..... B21C 37/0811 228/144 |
| 2006/0169368 | A1 | 8/2006 | Lopez et al. |
| 2006/0231168 | A1 | 10/2006 | Nakamura et al. |
| 2006/0231186 | A1 | 10/2006 | Minami et al. |
| 2006/0243355 | A1 | 11/2006 | Haiderer et al. |
| 2006/0273586 | A1 | 12/2006 | Reynolds, Jr. et al. |
| 2007/0039147 | A1 | 2/2007 | Roussie |
| 2007/0039149 | A1 | 2/2007 | Roussie |
| 2007/0089813 | A1 | 4/2007 | Tivelli |
| 2007/0137736 | A1 | 6/2007 | Omura et al. |
| 2007/0216126 | A1 | 9/2007 | Lopez et al. |
| 2007/0246219 | A1 | 10/2007 | Manella et al. |
| 2008/0047635 | A1 | 2/2008 | Kanda et al. |
| 2008/0115863 | A1 | 5/2008 | McCrink et al. |
| 2008/0129044 | A1 | 6/2008 | Carcagno et al. |
| 2008/0219878 | A1 | 9/2008 | Kanda et al. |
| 2008/0226396 | A1 | 9/2008 | Garcia et al. |
| 2008/0226491 | A1 | 9/2008 | Satou et al. |
| 2008/0257459 | A1 | 10/2008 | Arai et al. |
| 2008/0264129 | A1 | 10/2008 | Cheppe et al. |
| 2008/0286504 | A1 | 11/2008 | Asahi et al. |
| 2008/0303274 | A1 | 12/2008 | Mazzaferro et al. |
| 2008/0314481 | A1 | 12/2008 | Garcia et al. |
| 2009/0010794 | A1 | 1/2009 | Turconi et al. |
| 2009/0033087 | A1 | 2/2009 | Carcagno et al. |
| 2009/0047166 | A1 | 2/2009 | Tomomatsu et al. |
| 2009/0101242 | A1 | 4/2009 | Lopez et al. |
| 2009/0114318 | A1 | 5/2009 | Arai et al. |
| 2009/0148334 | A1 | 6/2009 | Stephenson |
| 2009/0226491 | A1 | 9/2009 | Satou et al. |
| 2009/0226988 | A1 | 9/2009 | Tajima et al. |
| 2010/0136363 | A1 | 6/2010 | Valdez et al. |
| 2010/0187808 | A1 | 7/2010 | Santi |
| 2010/0193085 | A1 | 8/2010 | Garcia |
| 2010/0206553 | A1 | 8/2010 | Bailey et al. |
| 2010/0294401 | A1 | 11/2010 | Gomez |
| 2010/0319814 | A1 | 12/2010 | Perez |
| 2010/0327550 | A1 | 12/2010 | Lopez |
| 2011/0042946 | A1 | 2/2011 | Santi |
| 2011/0077089 | A1 | 3/2011 | Hirai et al. |
| 2011/0097235 | A1 | 4/2011 | Turconi et al. |
| 2011/0133449 | A1 | 6/2011 | Mazzaferro |
| 2011/0233925 | A1 | 9/2011 | Pina |
| 2011/0247733 | A1 | 10/2011 | Arai et al. |
| 2011/0259482 | A1 | 10/2011 | Peters |
| 2011/0284137 | A1 | 11/2011 | Kami et al. |
| 2012/0018056 | A1 | 1/2012 | Nakagawa et al. |
| 2012/0186686 | A1 | 7/2012 | Valdez |
| 2012/0199255 | A1 | 8/2012 | Anelli |
| 2012/0267014 | A1 | 10/2012 | Hitoshio et al. |
| 2013/0000790 | A1 | 1/2013 | Arai et al. |
| 2013/0004787 | A1 | 1/2013 | Ishiyama et al. |
| 2013/0199674 | A1 | 8/2013 | Altschuler et al. |
| 2013/0264123 | A1 | 10/2013 | Altschuler et al. |
| 2014/0021244 | A1 | 1/2014 | DuBois |
| 2014/0027497 | A1 | 1/2014 | Rowland et al. |
| 2014/0057121 | A1 | 2/2014 | Altschuler et al. |
| 2014/0137992 | A1 | 5/2014 | Ishiguro et al. |
| 2014/0251512 | A1 | 9/2014 | Gomez |
| 2014/0272448 | A1 | 9/2014 | Valdez et al. |
| 2014/0299235 | A1 | 10/2014 | Anelli |
| 2014/0299236 | A1 | 10/2014 | Anelli |
| 2015/0368986 | A1 | 12/2015 | Narikawa |
| 2016/0024625 | A1 | 1/2016 | Valdez |
| 2016/0102856 | A1 | 4/2016 | Minami |
| 2016/0281188 | A1 | 9/2016 | Valdez et al. |
| 2016/0305192 | A1 | 10/2016 | Buhler |
| 2018/0044747 | A1 | 2/2018 | Valdez et al. |
| 2018/0051353 | A1 | 2/2018 | Valdez et al. |

FOREIGN PATENT DOCUMENTS

| | | |
|---|---|---|
| CA | 2319926 | 7/2008 |
| CA | 2685001 | 11/2008 |
| CN | 1401809 | 3/2003 |
| CN | 1487112 | 4/2004 |
| CN | 1292429 | 12/2006 |
| CN | 101480671 | 7/2009 |
| CN | 101542002 | 9/2009 |
| CN | 101613829 | 12/2009 |
| CN | 101413089 | 11/2010 |
| CN | 101898295 | 12/2010 |
| DE | 3310226 | 10/1984 |
| DE | 4446806 | 5/1996 |
| EA | 010037 | 6/2008 |
| EA | 012256 | 8/2009 |
| EP | 0032265 | 7/1981 |
| EP | 0092815 | 11/1983 |
| EP | 0104720 | 4/1984 |
| EP | 0159385 | 10/1985 |
| EP | 0309179 | 3/1989 |
| EP | 0340385 | 11/1989 |
| EP | 0329990 | 11/1992 |
| EP | 0658632 | 6/1995 |
| EP | 0753595 | 1/1997 |
| EP | 0788850 | 8/1997 |
| EP | 0828007 | 3/1998 |
| EP | 0989196 | 3/2000 |
| EP | 1008660 | 6/2000 |
| EP | 1027944 | 8/2000 |
| EP | 1065423 | 1/2001 |

(56) References Cited

FOREIGN PATENT DOCUMENTS

| | | | |
|---|---|---|---|
| EP | 0828007 | | 11/2001 |
| EP | 1269059 | | 1/2003 |
| EP | 1277848 | | 1/2003 |
| EP | 1288316 | | 3/2003 |
| EP | 1296088 | | 3/2003 |
| EP | 1362977 | | 11/2003 |
| EP | 1413639 | | 4/2004 |
| EP | 1182268 | | 9/2004 |
| EP | 1705415 | | 9/2006 |
| EP | 1717324 | | 11/2006 |
| EP | 1726861 | | 11/2006 |
| EP | 1876254 | | 1/2008 |
| EP | 1914324 | | 4/2008 |
| EP | 2000629 | | 12/2008 |
| EP | 1554518 | | 1/2009 |
| EP | 2028284 | | 2/2009 |
| EP | 2133442 | | 12/2009 |
| EP | 2447386 | | 2/2010 |
| EP | 2216576 | | 8/2010 |
| EP | 2239343 | | 10/2010 |
| EP | 2729590 | | 1/2013 |
| FR | 1149513 | | 12/1957 |
| FR | 1489013 | | 7/1967 |
| FR | 2 704 042 | A | 10/1994 |
| FR | 2 848 282 | A1 | 6/2004 |
| FR | 2855587 | | 12/2004 |
| GB | 498472 | | 1/1939 |
| GB | 1 398 214 | | 6/1973 |
| GB | 1 428 433 | | 3/1976 |
| GB | 2 104 919 | A | 3/1983 |
| GB | 2 234 308 | | 1/1991 |
| GB | 2 276 647 | | 10/1994 |
| GB | 2 388169 | | 11/2003 |
| JP | S522825 | | 1/1977 |
| JP | 58-187684 | | 12/1983 |
| JP | 60-086209 | | 5/1985 |
| JP | S60 11 6796 | | 6/1985 |
| JP | 60-215719 | | 10/1985 |
| JP | 36025719 | | 10/1985 |
| JP | S60215719 | | 10/1985 |
| JP | S60261888 | | 12/1985 |
| JP | S61-103061 | | 5/1986 |
| JP | 61 270355 | | 11/1986 |
| JP | 63 004046 | | 1/1988 |
| JP | 63 004047 | | 1/1988 |
| JP | 63-230847 | A2 | 9/1988 |
| JP | 63230851 | | 9/1988 |
| JP | 01-242761 | | 9/1989 |
| JP | 01 259124 | | 10/1989 |
| JP | 01 259125 | | 10/1989 |
| JP | 01 283322 | | 11/1989 |
| JP | 05-098350 | | 12/1990 |
| JP | 403006329 | | 1/1991 |
| JP | 04 021718 | | 1/1992 |
| JP | 04 107214 | | 4/1992 |
| JP | 04 231414 | | 8/1992 |
| JP | H0574928 | | 10/1993 |
| JP | 05 287381 | | 11/1993 |
| JP | H06-042645 | | 2/1994 |
| JP | 06-093339 | | 4/1994 |
| JP | 06 172859 | | 6/1994 |
| JP | 06-220536 | | 8/1994 |
| JP | 07-003330 | | 1/1995 |
| JP | 07 041856 | | 2/1995 |
| JP | 07-139666 | | 5/1995 |
| JP | 07 197125 | | 8/1995 |
| JP | 08 311551 | | 11/1996 |
| JP | 09 067624 | | 3/1997 |
| JP | H09217120 | | 8/1997 |
| JP | 09-235617 | | 9/1997 |
| JP | 2704042 | | 10/1997 |
| JP | 10 140250 | | 5/1998 |
| JP | 10 176239 | | 6/1998 |
| JP | 10 280037 | | 10/1998 |
| JP | 11 050148 | | 2/1999 |
| JP | 11 140580 | | 5/1999 |
| JP | 11 229079 | | 8/1999 |
| JP | 2000-063940 | | 2/2000 |
| JP | 2000-178645 | | 6/2000 |
| JP | 2000-248337 | | 9/2000 |
| JP | 2000-313919 | | 11/2000 |
| JP | 2001-131698 | | 5/2001 |
| JP | 2001-164338 | | 6/2001 |
| JP | 2001-172739 | | 6/2001 |
| JP | 2001220653 | | 8/2001 |
| JP | 2001220653 | A * | 8/2001 |
| JP | 2001-271134 | | 10/2001 |
| JP | 2002-096105 | | 4/2002 |
| JP | 2002-130554 | | 5/2002 |
| JP | 2004-011009 | | 1/2004 |
| JP | 2007-031769 | | 7/2005 |
| JP | 60 174822 | | 9/2005 |
| KR | 0245031 | | 3/2000 |
| KZ | 1418 | B | 12/1994 |
| KZ | 2506 | B | 9/1995 |
| KZ | 2673 | B | 12/1995 |
| UA | 51138 | A | 11/2002 |
| WO | WO 1984/002947 | | 8/1984 |
| WO | WO 1994/29627 | | 12/1994 |
| WO | WO 1996/22396 | | 7/1996 |
| WO | WO 2000/06931 | | 2/2000 |
| WO | WO 2000/70107 | | 11/2000 |
| WO | WO 2001/075345 | | 10/2001 |
| WO | WO 2001/88210 | | 11/2001 |
| WO | WO 2002/29290 | | 4/2002 |
| WO | WO 2002/035128 | | 5/2002 |
| WO | WO 2002/068854 | | 9/2002 |
| WO | WO 2002/086369 | | 10/2002 |
| WO | WO 2002/093045 | | 11/2002 |
| WO | WO 2003/033856 | | 4/2003 |
| WO | WO 2003/048623 | | 6/2003 |
| WO | WO 2003/087646 | | 10/2003 |
| WO | WO 2004/023020 | | 3/2004 |
| WO | WO 2004/031420 | | 4/2004 |
| WO | WO 2004/033951 | | 4/2004 |
| WO | WO 2004/053376 | | 6/2004 |
| WO | WO 2004/097059 | | 11/2004 |
| WO | WO 2004/109173 | | 12/2004 |
| WO | WO 2006/003775 | | 6/2005 |
| WO | WO 2005/080621 | | 9/2005 |
| WO | WO 2006/009142 | | 1/2006 |
| WO | WO 2006/087361 | | 4/2006 |
| WO | WO2006078768 | | 7/2006 |
| WO | WO2006086143 | | 8/2006 |
| WO | WO 2007/002576 | | 1/2007 |
| WO | WO 2007/017082 | | 2/2007 |
| WO | WO 2007/017161 | | 2/2007 |
| WO | WO 2007/023806 | | 3/2007 |
| WO | WO 2007/028443 | | 3/2007 |
| WO | WO 2007/034063 | | 3/2007 |
| WO | WO 2007/063079 | | 6/2007 |
| WO | WO 2008/003000 | | 1/2008 |
| WO | WO 2008/007737 | | 1/2008 |
| WO | WO 2008/090411 | | 7/2008 |
| WO | WO 2008/110494 | | 9/2008 |
| WO | WO 2008/127084 | | 10/2008 |
| WO | WO 2009/000851 | | 12/2008 |
| WO | WO 2009/000766 | | 1/2009 |
| WO | WO 2009/010507 | | 1/2009 |
| WO | WO 2009/027308 | | 3/2009 |
| WO | WO 2009/027309 | | 3/2009 |
| WO | WO 2009/044297 | | 4/2009 |
| WO | WO 2009/065432 | | 5/2009 |
| WO | WO 2009/106623 | | 9/2009 |
| WO | WO 2010/061882 | | 6/2010 |
| WO | WO 2010/122431 | | 10/2010 |
| WO | WO 2011 /152240 | | 12/2011 |
| WO | WO2013007729 | | 1/2013 |

OTHER PUBLICATIONS

International Conference and Exhibition on Coiled Tubing Technology: Operations, Services, Practices, held at Adams Mark hotel

(56) References Cited

OTHER PUBLICATIONS in Houston on or about Mar. 28-31, 1994, document bears the date of Mar. 1, 1994, 20 pages (1-20), of the 60 page composite document submitted herewith as Desig, ID 48.
[No Author Listed], "Southwestern Pipe, Inc.—Cymax Coiled Tubing," Unknown if this document was publicly disclosed, Date of publication unknown, but presumably prior to the earliest claimed priority date for the pending application, 1 page (p. 22) of the 60 page composite document submitted herewith as Desig. ID 48.
[No Author Listed], "CYMAX Division—Coiled Tubing Reel Sizes," Unknown if this document was publicly disclosed, Date of publication unknown, but presumably prior to the earliest claimed priority date for the pending application, 1 page (p. 24) of the 60 page composite document submitted herewith as Desig. ID 48.
[No Author Listed], "Coiled Tubing String Design," Unknown if this document was publicly disclosed, Date of publication unknown, but presumably prior to the earliest claimed priority date for the pending application, 2 pages (25- 26) of the 60 page composite document submitted herewith as Desig. ID 48.
"Southwestern Pipe Inc., Specification for Cymax 80 High Strength Low Alloy Steel Coiled Tubing for Sour Environment Service," Date of publication unknown, but presumably prior to the earliest claimed priority date for the pending application; document bears the date Sep. 1, 1993, 2 pages (28-29) of the 60 page composite document submitted herewith as Desig. ID 48.
"Southwestern Pipe Inc., Specification for Cymax 100 High Strength Low Alloy Steel Coiled Tubing for Sour Environment Service," Date of publication unknown, but presumably prior to the earliest claimed priority date for the pending application; document bears the date Sep. 1, 1993, 2 pages (30-31) of the 60 page composite document submitted herewith as Desig. ID 48.
[No Author Listed], "The Development and Testing of CYMAX 100 Coiled Tubing," Date of publication unknown, but presumably prior to the earliest claimed priority date for the pending application; document bears the date Jan. 1992 and is cited in the bibliography of the Full Body Quenched and Tempered Coiled Tubing dated Mar. 1, 1994, 15 pages (33-47) of the 60 page composite document submitted herewith as Desig. ID 48.
[No Author Listed], "Orbital TIG Welding Cymax Coiled Tubing," Unknown if this document was publicly disclosed, Date of publication unknown, but presumably prior to the earliest claimed priority date for the pending application; document bears the date Nov. 1992, 13 pages (48-60) of the 60 page composite document submitted herewith as Desig. ID 48.
Divider Pages labeled "Southwestern Pipe Inc."; "CYMAX Division"; "Coiled Tubing Specifications"; "Technical Data—Introduction"; "Product Data—Specifications—Technical Papers" Date of publication unknown, but presumably prior to the earliest claimed priority date for the pending application; 4 pages (21, 23, 27, and 32) of the 60 page composite document submitted herewith as Desig. ID 48.
"Untitled Composite of Multiple Documents", Cymax Division, Southwestern Pipe, Inc.; Date of publication unknown, but presumably prior to the earliest claimed priority date for the pending application, document bears the date of Mar. 1, 1994, 60 pages; document is a composite of the documents submitted herewith as Desig. ID Nos. 39-47.
Chitwood, G. B., et al.: "High-Strength Coiled Tubing Expands Service Capabilities", as presented at the 24th Annual OTC in Houston, Texas, May 4-7, 1992, 15 pages.
Chinese Office Action for Application No. 201210020833.5 with English Translation dated on May 5, 2015.
European Extended Search Report re EPO Application No. 12152516.6, dated Jun. 25, 2012.
European Search Report and Opinion, re EPO Application No. EP 14159174.3, dated Jul. 3, 2014.
Faszold et al., "Full-Scale Fatigue Testing With 130K Yield Tubing." Paper SPE-153945, Presented at SPE/ICoTA Coiled Tubing & Well Intervention Conference and Exhibition Jan. 2012, Society of Petroleum Engineers, 6 pages.
First Chinese Office Action for Application No. 201210020833.5 with English Translation dated on Aug. 4, 2014.
Hollomon, J.H., et al., Time-tempered Relations in Tempering Steel. New York Meeting, 1945, pp. 223-249.
International Standard Publication. Petroleum and natural gas industries—Materials for use in H2S-containing environments in oil and gas production. ANSI/NACE ISO, 2009, 145 pages.
Pollack, Herman, W., Materials Science and Metallurgy, Fourth Edition, pp. 96 and 97, 1988, 2 pages.
Savatori et. al. European Commision Report, EUR 2006, EUR2207, STN Abstract, 3 pages.
Tenaris brochure. Coiled Tubes HS8OCRA, 2 pages, 2008.
Tenaris brochure. Coiled Tubes Suggested Field Welding Procedure (GTAW) for Coiled Tubing Grads HS70, HS80, HS90, HS110, 2007, 3 pages.
Tenaris brochure. Coiled Tubing for Downhole Applications, 2007, 10 pages.
Docket sheet from *Global Tubing, LLC* vs. *Tenaris Coiled Tubes, LLC et al.*, case No. 4:17-cv-03299 in the United States District Court for the Southern District of Texas, Houston Division, 31 pages.
United States District Court for the Southern District of Texas, Houston Division, Global's Final Invalidity Contentions, Civil Action No. 4:17-cv-03299, dated Apr. 12, 2021, 59 pages.
Exhibit A-1 Identification of Asserted Claims and Limitations Therein, U.S. Pat. No. 9,803,256, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 19 pages, 4 pages.
Exhibit A-2 U.S. Pat. No. 9,803,256, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 19 pages, 30 pages.
Exhibit A-3 Altschuler 715, served by Global Tubing, LLC on Apr. 12, 2021 (and referring to a document beginning with p. GT0011425) in *Global Tubing, LLC* vs. *Tenaris Coiled Tubes, LLC et al.*, case No. 4:17-cv-03299 in the United States District Court for the Southern District of Texas, Houston Division, 19 pages.
Exhibit A-3 Altschuler 856, served by Global Tubing, LLC on Apr. 12, 2021 (and referring to a document beginning with p. GT0011442) in *Global Tubing, LLC* vs. *Tenaris Coiled Tubes, LLC et al.*, case No. 4:17-cv-03299 in the United States District Court for the Southern District of Texas, Houston Division, 17 pages.
Exhibit A-3 API Specification, American Petroleum Institute, Specification for Coiled Tubing, API Specification 5ST, served by Global Tubing, LLC on Apr. 12, 2021 (and referring to a document beginning with p. GT0224055) in *Global Tubing, LLC* vs. *Tenaris Coiled Tubes, LLC et al.*, case No. 4:17-cv-03299 in the United States District Court for the Southern District of Texas, Houston Division, 13 pages.
Exhibit A-3 Asano (Supplemental), served by Global Tubing, LLC on Apr. 12, 2021 (and referring to documents beginning with p. GT0011542 and GT0011547) in *Global Tubing, LLC* vs. *Tenaris Coiled Tubes, LLC et al.*, case No. 4:17-cv-03299 in the United States District Court for the Southern District of Texas, Houston Division, 18 pages.
Exhibit A-3 Chitwood, High Strength Coiled Tubing Expands Service Capabilities, served by Global Tubing on Apr. 12, 2021 (and referring to a document beginning with p. GT0023898 and ending with p. GT0023913) in *Global Tubing, LLC* vs. *Tenaris Coiled Tubes, LLC et al.*, case No. 4:17-cv-03299 in the United States District Court for the Southern District of Texas, Houston Division, 28 pages.
Exhibit A-3 Crowther, served by Global Tubing, LLC on Apr. 12, 2021 (and referring to a document beginning with p. GT0012789) in *Global Tubing, LLC* vs. *Tenaris Coiled Tubes, LLC et al.*, case No. 4:17-cv-03299 in the United States District Court for the Southern District of Texas, Houston Division, 23 pages.
Exhibit A-3 CT Manual (Supplemental), Coiled Tubing Manual, served by Global Tubing, LLC on Apr. 12, 2021 (and referring to a document beginning with p. GT0011855) in *Global Tubing, LLC* vs.

(56) References Cited

OTHER PUBLICATIONS

*Tenaris Coiled Tubes, LLC et al.*, case No. 4:17-cv-03299 in the United States District Court for the Southern District of Texas, Houston Division, 15 pages.
Exhibit A-3 CYMAX 100, served by Global Tubing, LLC on Apr. 12, 2021 in *Global Tubing, LLC* vs. *Tenaris Coiled Tubes, LLC et al.*, case No. 4:17-cv-03299 in the United States District of Texas, Houston Division, 22 pages.
Exhibit A-3 CYMAX Brochure, served by Global Tubing, LLC on Apr. 12, 2021 (and referring to a document labeled with pp. TCT0009950-89) in *Global Tubing, LLC* vs. *Tenaris Coiled Tubes, LLC et al.*, case No. 4:17-cv-03299 in the United States District Court for the Southern District of Texas, Houston Division, 21 pages.
Exhibit A-3 Eguchi 681, served by Global Tubing, LLC on Apr. 12, 2021 (and referring to a document beginning with p. GT0012866 and ending with p. GT0012878) in *Global Tubing, LLC* vs. *Tenaris Coiled Tubes, LLC et al.*, case No. 4:17-cv-03299 in the United States District Court for the Southern District of Texas, Houston Division, 26 pages.
Exhibit A-3 Eguchi 2012, served by Global Tubing, LLC on Apr. 12, 2021 (and referring to a document beginning with p. GT0012879) in *Global Tubing, LLC* vs. *Tenaris Coiled Tubes, LLC et al.*, case No. 4:17-cv-03299 in the United States District Court for the Southern District of Texas, Houston Division, 24 pages.
Exhibit A-3 Feng, served by Global Tubing, LLC on Apr. 12, 2021 (and referring to a document beginning with p. GT0283198) in *Global Tubing, LLC* vs *Tenaris Coiled Tubes, LLC et al.*, case No. 4:17-cv-03299 in the United States District Court for the Southern District of Texas, Houston Division, 15 pages.
Exhibit A-3 Fujishiro, served by Global Tubing, LLC on Apr. 12, 2021 (and referring to a document beginning with p. GT0025074 and ending with p. GT0025083) in *Global Tubing, LLC* vs *Tenaris Coiled Tubes, LLC et al.*, case No. 4:17-cv-03299 in the United States District Court for the Southern District of Texas, Houston Division, 21 pages.
Exhibit A-3 Kushida, served by Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 22 pages.
Exhibit A-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 14 pages.
Exhibit A-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 20 pages.
Exhibit A-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 17 pages.
Exhibit A-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT03727329-TCT0374535) in *Global Tubing, LLC* vs. *Tenaris Coiled Tubes, LLC et al.*, case No. 4:17-cv-03299 in the United States District Court for the Southern District of Texas, Houston Division, 16 pages.
Exhibit A-3 SeaCAT Specification, served by Global Tubing, LLC on Apr. 12, 2021 (and referring to a document beginning with p. GT0210506) in *Global Tubing, LLC* vs. *Tenaris Coiled Tubes, LLC et al.*, case No. 4:17- cv-03299 in the United States District Court for the Southern District of Texas, Houston Division, 12 pages.
Exhibit A-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 17 pages.
Exhibit A-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 21 pages.
Exhibit A-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 22 pages.
Exhibit A-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 19 pages.
Exhibit A-3 Valdez 2010, served by Global Tubing, LLC on Apr. 12, 2021 (and referring to a document beginning with p. GT0011261) in *Global Tubing, LLC* vs. *Tenaris Coiled Tubes, LLC et al.*, case No. 4:17-cv-03299 in the United States District Court for the Southern District of Texas, Houston Division, 16 pages.
Exhibit A-3 Williams, served by Global Tubing, LLC on Apr. 12, 2021 (and referring to a document beginning with p. GT0011295) in *Global Tubing, LLC* vs. *Tenaris Coiled Tubes, LLC et al.*, case No. 4:17-cv-03299 in the United States District Court for the Southern District of Texas, Houston Division , 13 pages.
Exhibit A-3 Zernick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division, 18 pages.
Exhibit B-1, Identification of Asserted Claims and Limitations Therein, U.S. Pat. No. 10,378,074, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 4 pages.
Exhibit B-2, U.S. Pat. No. 10,378,074, 28 pages with Exhibit B-3 Attachments totaling 233 pages, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division.
Exhibit B-3 Altschuler 715, served by Global Tubing, LLC on Apr. 12, 2021 (and referring to a document beginning with p. GT0011425) in *Global Tubing, LLC* vs. *Tenaris Coiled Tubes, LLC et al.*, case No. 4:17-cv-03299 in the United States District Court for the Southern District of Texas, Houston Division, 9 pages.
Exhibit B-3 Altschuler 856, served by Global Tubing, LLC on Apr. 12, 2021 (and referring to a document beginning with p. GT0011442) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 API Specification, American Petroleum Institute, Specification for Coiled Tubing, API Specification 5ST, served by Global Tubing, LLC on Apr. 12, 2021 (and referring to a document beginning with p. GT0224055) in *Global Tubing, LLC* vs *Tenaris Coiled Tubes, LLC et al.*, case No. 4:17-cv-03299 in the United States District Court for the Southern District of Texas, Houston Division, 7 pages.
Exhibit B-3 Asano (Supplemental), served by Global Tubing, LLC on Apr. 12, 2021 (and referring to documents beginning with p. GT0011542 and GT0011547) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Chitwood, High Strength Coiled Tubing Expands Service Capabilities, served by Global Tubing on Apr. 12, 2021 (and referring to a document beginning with p. GT0023898 and ending with p. GT0023913) in *Global Tubing, LLC* vs. *Tenaris Coiled Tubes, LLC et al.*, case No. 4:17-cv-03299 in the United States District Court for the Southern District of Texas, Houston Division, 7 pages.

(56) References Cited

OTHER PUBLICATIONS

Exhibit B-3 Crowther, served by Global Tubing, LLC on Apr. 12, 2021 (and referring to a document beginning with p. GT0012789) in *Global Tubing, LLC* vs. *Tenaris Coiled Tubes, LLC et al.*, case No. 4:17-cv-03299 in the United States District Court for the Southern District of Texas, Houston Division, 10 pages.
Exhibit B-3 CT Manual (Supplemental), Coiled Tubing Manual, served by Global Tubing, LLC on Apr. 12, 2021 (and referring to a document beginning with p. GT0011855) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 CYMAX 100, served by Global Tubing, LLC on Apr. 12, 2021 in *Global Tubing, LLC* vs. *Tenaris Coiled Tubes, LLC et al.*, case No. 4:17-cv-03299 in the United States District of Texas, Houston Division, 8 pages.
Exhibit B-3 CYMAX Brochure, served by Global Tubing, LLC on Apr. 12, 2021 (and referring to a document labeled with pp. TCT0009950-89) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Eguchi 681, served by Global Tubing, LLC on Apr. 12, 2021 (and referring to a document beginning with p. GT0012866 and ending with p. GT0012878) in *Global Tubing, LLC* vs. *Tenaris Coiled Tubes, LLC et al.*, case No. 4:17-cv-03299 in the United States District Court for the Southern District of Texas, Houston Division 11 pages.
Exhibit B-3 Eguchi 2012, served by Global Tubing, LLC on Apr. 12, 2021 (and referring to a document beginning with p. GT0012879) in *Global Tubing, LLC* vs. *Tenaris Coiled Tubes, LLC et al.*, case No. 4:17-cv-03299 in the United States District Court for the Southern District of Texas, Houston Division, 12 pages.
Exhibit B-3 Feng, served in Global Tubing, LLC on Apr. 12, 2021 (and referring to a document beginning with p. GT0283198) in *Global Tubing, LLC* vs *Tenaris Coiled Tubes, LLC et al.*, case No. 4:17-cv-03299 in the United States District Court for the Southern District of Texas, Houston Division 10 pages.
Exhibit B-3 Fujishiro, served in Global Tubing, LLC on Apr. 12, 2021 (and referring to a document beginning with p. GT0025074 and ending with p. GT0025083) in *Global Tubing, LLC*, vs *Tenaris Coiled Tubes, LLC et al.*, case No. 4:17-cv-03299 in the United States District Court for the Southern District of Texas, Houston Division, 10 pages.
Exhibit B-3 Kushida, served in Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 13 pages.
Exhibit B-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 6 pages.
Exhibit B-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 19 pages.
Exhibit B-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 9 pages.
Exhibit B-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT0372730, TCT0374535) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 SeaCAT Specification, served by Global Tubing, LLC on Apr. 12, 2021 (and referring to a document beginning with p. GT0210506) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 11 pages.
Exhibit B-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 11 pages.
Exhibit B-3 Valdez 2010, served by Global Tubing, LLC on Apr. 12, 2021 (and referring to a document beginning with p. GT0011261) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Williams, served by Global Tubing, LLC on Apr. 12, 2021 (and referring to a document beginning with p. GT0011295) in *Global Tubing, LLC* vs. *Tenaris Coiled Tubes, LLC et al.*, case No. 4:17-cv-03299 in the United States District Court for the Southern District of Texas, Houston Division , 7 pages.
Exhibit B-3 Zernick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division , 7 pages.
Exhibit C-1, Identification of Asserted Claims and Limitations Therein, U.S. Pat. No. 10,378,075, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 4 pages.
Exhibit C-2, U.S. Pat. No. 10,378,075, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 6 pages with Exhibit C-3 Attachments totaling 260 pages.
Exhibit C-3 Altschuler 715, served by Global Tubing, LLC on Apr. 12, 2021 (and referring to a document beginning with p. GT0011425) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Altschuler 856, served by Global Tubing, LLC on Apr. 12, 2021 (and referring to a document beginning with p. GT0011442) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 API Specification, American Petroleum Institute, Specification for Coiled Tubing, API Specification 5ST, served by Global Tubing, LLC on Apr. 12, 2021 (and referring to a document beginning with No. GT0224055) in *Global Tubing, LLC* vs *Tenaris Coiled Tubes, LLC et al.*, case No. 4:17-cv-03299 in the United States District Court for the Southern District of Texas, Houston Division, 5 pages.
Exhibit C-3 Asano (Supplemental), served by Global Tubing, LLC on Apr. 12, 2021 (and referring to documents beginning with p. GT0011542 and GT0011547) in *Global Tubing, LLC* vs. *Tenaris Coiled Tubes, LLC et al.*, case No. 4:17-cv-03299 in the United States District Court for the Southern District of Texas, Houston Division, 5 pages.

(56) References Cited

OTHER PUBLICATIONS

Exhibit C-3 Chitwood, High Strength Coiled Tubing Expands Service Capabilities, served by Global Tubing, LLC on Apr. 12, 2021 (and referring to a document beginning with p. GT0023898 and ending with p. GT0023913) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Crowther, served by Global Tubing, LLC on Apr. 12, 2021 (and referring to a document beginning with p. GT0012789) in *Global Tubing, LLC*, vs. *Tenaris Coiled Tubes, LLC et al.*, case No. 4:17-cv-03299 in the United States District Court for the Southern District of Texas, Houston Division, 5 pages.
Exhibit C-3 CT Manual (Supplemental), Coiled Tubing Manual, served by Global Tubing, LLC on Apr. 12, 2021 (and referring to a document beginning with p. GT0011855) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 CYMAX 100, served by Global Tubing, LLC on Apr. 12, 2021 in *Global Tubing, LLC* vs. *Tenaris Coiled Tubes, LLC et al.*, case No. 4:17-cv-03299 in the United States District of Texas, Houston Division, 5 pages.
Exhibit C-3 CYMAX Brochure, served by Global Tubing, LLC on Apr. 12, 2021 (and referring to a document labeled with pp. TCT0009950-89) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Eguchi 681, served by Global Tubing, LLC on Apr. 12, 2021 (and referring to a document beginning with p. GT0012866 and ending with p. GT0012878) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Eguchi 2012, served by Global Tubing, LLC on Apr. 12, 2021 (and referring to a document beginning with p. GT0012879) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Feng, served in Global Tubing, LLC on Apr. 12, 2021 (and referring to a document beginning with p. GT0283198) in *Global Tubing, LLC*, vs *Tenaris Coiled Tubes, LLC et al.*, case No. 4:17-cv-03299 in the United States District Court for the Southern District of Texas, Houston Division, 5 pages.
Exhibit C-3 Fujishiro, served in Global Tubing, LLC on Apr. 12, 2021 (and referring to a document beginning with p. GT0025074 and ending with p. GT0025083) in *Global Tubing, LLC*, vs *Tenaris Coiled Tubes, LLC et al.*, case No. 4:17-cv-03299 in the United States District Court for the Southern District of Texas, Houston Division, 5 pages.
Exhibit C-3 Kushida, served in Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT0372730, TCT0374535) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 SeaCAT Specification, served by Global Tubing, LLC on Apr. 12, 2021 (and referring to a document beginning with p. GT0210506) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Valdez 2010, served by Global Tubing, LLC on Apr. 12, 2021 (and referring to a document beginning with p. GT0011261) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Williams, served by Global Tubing, LLC on Apr. 12, 2021 (and referring to a document beginning with p. GT0011295) in *Global Tubing, LLC* vs. *Tenaris Coiled Tubes, LLC et al.*, case No. 4:17-cv-03299 in the United States District Court for the Southern District of Texas, Houston Division , 5 pages.
Exhibit C-3 Zernick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division, 5 pages.
U.S. Pat. No. 5,662,145, dated Sep. 2, 1997, served by Global Tubing, LLC on Apr. 12, 2021 as Nos. GT0011220-GT0011231 in *Global Tubing, LLC* vs. *Tenaris Coiled Tubes, LLC et al.*, case No. 4:17-cv-03299 in the United States District Court for the Southern District of Texas, Houston Division, 12 pages.
Timkin "Practical Data for Metallurgists", published 1993, served by Global Tubing, LLC on Apr. 12, 2021 as Nos. GT0011232-GT00 11236 in *Global Tubing, LLC* vs. *Tenaris Coiled Tubes, LLC et al.*, case No. 4:17-cv-03299 in the United States District Court for the Southern District of Texas, Houston Division, 5 pages.
U.S. Pat. No. 7,862,667, dated Jan. 4, 2011, served by Global Tubing, LLC on Apr. 12, 2021 as Nos. GT0011237-GT00 11252 in *Global Tubing, LLC* vs. *Tenaris Coiled Tubes, LLC et al.*, case No. 4:17-cv-03299 in the United States District Court for the Southern District of Texas, Houston Division, 16 pages.
Urayama et al., "Research and Development of Advanced Coiled-Tubing Construction and Performance", published Jun. 1, 2001, served by Global Tubing, LLC on Apr. 12, 2021 as Nos. GT0011253-GT0011260 in *Global Tubing, LLC* vs. *Tenaris Coiled Tubes, LLC et al.*, case No. 4:17-cv-03299 in the United States District Court for the Southern District of Texas, Houston Division, 8 pages.
United States Publication No. 2010/0136363 A1, Jun. 3, 2010, served by Global Tubing, LLC on Apr. 12, 2021 as Nos. GT0011261-GT0011279 in *Global Tubing, LLC* vs. *Tenaris Coiled Tubes, LLC et al.*, case No. 4:17-cv-03299 in the United States District Court for the Southern District of Texas, Houston Division, 19 pages.

(56) References Cited

OTHER PUBLICATIONS

Williams, et al., "Mensa Project: Hydraulic Umbilicals", OTC 8629, Offshore Technology Conference, 1998, served by Global Tubing, LLC on Apr. 12, 2021 as Nos. GT0011295-GT0011299 in *Global Tubing, LLC* vs. *Tenaris Coiled Tubes, LLC et al.*, case No. 4:17-cv-03299 in the United States District Court for the Southern District of Texas, Houston Division, 5 pages.

Zernick, Bill, "The Development and testing of CYMAX 100 Coiled Tubing", from "Benefits of full body quench and tempered coiled tubing", First Annual Conference on Coiled Tubing Operations & Slimhole Drilling Practices, Mar. 1-4, 1993, served by Global Tubing, LLC on Apr. 12, 2021 as Nos. GT0011300-GT0011313 in *Global Tubing, LLC* vs. *Tenaris Coiled Tubes, LLC et al.*, case No. 4:17-cv-03299 in the United States District Court for the Southern District of Texas, Houston Division, 14 pages.

API Specification, "ISO 11960:2011 Petroleum and Natural Gas Industries Steel Pipes for Use as Casing or Tubing for Wells", published Jun. 2011, served by Global Tubing, LLC on Apr. 12, 2021 as Nos. GT0011314-GT0011404 in *Global Tubing, LLC* vs. *Tenaris Coiled Tubes, LLC et al.*, case No. 4:17-cv-03299 in the United States District Court for the Southern District of Texas, Houston Division, 91 pages.

Afghoul et al., "Coiled Tubing: The Next Generation", published in 2004, served by Global Tubing, LLC on Apr. 12, 2021 as Nos. GT0011405-GT0011424, in *Global Tubing, LLC* vs. *Tenaris Coiled Tubes, LLC et al.*, case No. 4:17-cv-03299 in the United States District Court for the Southern District of Texas, Houston Division, 20 pages.

U.S. Pat. No. 8,414,715, dated Apr. 9, 2013, served by Global Tubing, LLC on Apr. 12, 2021 as Nos. GT0011425-GT0011441 in *Global Tubing, LLC* vs. *Tenaris Coiled Tubes, LLC et al.*, case No. 4:17-cv-03299 in the United States District Court for the Southern District of Texas, Houston Division, 17 pages.

U.S. Pat. No. 8,636,856, dated Jan. 28, 2014, served by Global Tubing, LLC on Apr. 12, 2021 as Nos. GT0011442-GT00 11459 in *Global Tubing, LLC* vs. *Tenaris Coiled Tubes, LLC et al.*, case No. 4:17-cv-03299 in the United States District Court for the Southern District of Texas, Houston Division, 18 pages.

English translation of JP2010270394A to Asano et al., Dec. 2, 2010, served by Global Tubing, LLC on Apr. 12, 2021 as Nos. GT0011542-GT0011546 in *Global Tubing, LLC* vs. *Tenaris Coiled Tubes, LLC et al.*, case No. 4:17-cv-03299 in the United States District Court for the Southern District of Texas, Houston Division, 5 pages.

JP 2010-270394 A, Dec. 2, 2010, served by Global Tubing, LLC on Apr. 12, 2021 as Nos. GT0011547-GT0011555 in *Global Tubing, LLC* vs. *Tenaris Coiled Tubes, LLC et al.*, case No. 4:17-cv-03299 in the United States District Court for the Southern District of Texas, Houston Division, 9 pages.

ASTM Designation: A 606-75, "American Society for Testing and Materials" American National Standards Institute publication date unknown, served by Global Tubing, LLC on Apr. 12, 2021 as Nos. GT0011556-GT0011559, in *Global Tubing, LLC* vs. *Tenaris Coiled Tubes, LLC et al.*, case No. 4:17-cv-03299 in the United States District Court for the Southern District of Texas, Houston Division, 4 pages.

ASTM Designation: A 607-75 (Reapproved 1981), Standard Specification for Steel Sheet and Strip, Hot-Rolled and Cold-Rolled, High-Strength, Low-Alloy Columbium and/or Vanadium, publication date unknown, served by Global Tubing, LLC on Apr. 12, 2021 as Nos. GT0011560-GT0011563 in *Global Tubing, LLC* vs. *Tenaris Coiled Tubes, LLC et al.*, case No. 4:17-cv-03299 in the United States District Court for the Southern District of Texas, Houston Division, 4 pages.

ASTM Designation: A 715-81, Standard Specification for Steel Sheet and Strip, Hot-Rolled and Cold-Rolled, High-Strength, Low-Alloy with Improved Formability, publication date unknown, served by Global Tubing, LLC on Apr. 12, 2021 as Nos. GT0011564-GT0011567, in *Global Tubing, LLC* vs. *Tenaris Coiled Tubes, LLC et al.*, case No. 4:17-cv-03299 in the United States District Court for the Southern District of Texas, Houston Division, 4 pages.

Babu et al., "Effect of Austenitizing Temperature and Cooling Rate on the Structure and Properties of a Ultrahigh Strength Low Alloy Steel", 2006, served by Global Tubing, LLC on Apr. 12, 2021 as Nos. GT0011568-GT0011577, in *Global Tubing, LLC* vs. *Tenaris Coiled Tubes, LLC et al.*, case No. 4:17-cv-03299 in the United States District Court for the Southern District of Texas, Houston Division, 10 pages.

Bhadeshia, "Martensite and Bainite in Steels: Transformation Mechanism and Mechanical Properties", Jan. 1997, served by Global Tubing, LLC on Apr. 12, 2021 as Nos. GT0011578-GT0011588, in *Global Tubing, LLC* vs. *Tenaris Coiled Tubes, LLC et al.*, case No. 4:17-cv-03299 in the United States District Court for the Southern District of Texas, Houston Division, 11 pages.

Caballero et al., "The Microstructure of Continuously Cooled Tough Bainitic Steels", publication date unknown, served by Global Tubing, LLC on Apr. 12, 2021 as Nos. GT0011589-GT0011598 in *Global Tubing, LLC* vs. *Tenaris Coiled Tubes, LLC et al.*, case No. 4:17-cv-03299 in the United States District Court for the Southern District of Texas, Houston Division, 10 pages.

Caballero et al., "Influence of bainite morphology on impact toughness of continuously cooled cementite free bainitic steels", publication date unknown, served by Global Tubing, LLC on Apr. 12, 2021 as Nos. GT0011599-GT00 11606 in *Global Tubing, LLC* vs. *Tenaris Coiled Tubes, LLC et al.*, case No. 4:17-cv-03299 in the United States District Court for the Southern District of Texas, Houston Division, 8 pages.

CLI International "Final Report: Serviceability of Coiled Tubing for Sour Oil and Gas Wells", publication date unknown, served by Global Tubing, LLC on Apr. 12, 2021 as Nos. GT0011607-GT0011796 in *Global Tubing, LLC* vs. *Tenaris Coiled Tubes, LLC et al.*, case No. 4:17-cv-03299 in the United States District Court for the Southern District of Texas, Houston Division, 190 pages.

English translation of Chinese Patent No. 1873041A, Dec. 6, 2006, served by Global Tubing, LLC on Apr. 12, 2021 as Nos. GT0011821-GT0011827 in *Global Tubing, LLC* vs. *Tenaris Coiled Tubes, LLC et al.*, case No. 4:17-cv-03299 in the United States District Court for the Southern District of Texas, Houston Division, 7 pages.

English translation of Chinese Patent No. 101603156A, Dec. 16, 2009, served by Global Tubing, LLC on Apr. 12, 2021 as Nos. GT0011842-GT0011854 in *Global Tubing, LLC* vs. *Tenaris Coiled Tubes, LLC et al.*, case No. 4:17-cv-03299 in the United States District Court for the Southern District of Texas, Houston Division, 13 pages.

Cies, LP, "Coiled Tubing Manual", Rev. 72005-A, 2005, served by Global Tubing, LLC on Apr. 12, 2021 as Nos. GT0011855-GT0012788 in *Global Tubing, LLC* vs. *Tenaris Coiled Tubes, LLC et al.*, case No. 4:17-cv-03299 in the United States District Court for the Southern District of Texas, Houston Division, 934 pages.

European Patent 2729590 B 1, Oct. 28, 2015, served by Global Tubing, LLC on Apr. 12, 2021 as Nos. GT0012789-GT0012802 in *Global Tubing, LLC* vs. *Tenaris Coiled Tubes, LLC et al.*, case No. 4:17-cv-03299 in the United States District Court for the Southern District of Texas, Houston Division, 14 pages.

International Publication No. WO 2012/051335 A1, Apr. 19, 2012, served by Global Tubing, LLC on Apr. 12, 2021 as Nos. GT0012803-GT0012832 in *Global Tubing, LLC* vs. *Tenaris Coiled Tubes, LLC et al.*, case No. 4:17-cv-03299 in the United States District Court for the Southern District of Texas, Houston Division, 30 pages.

U.S. Pat. No. 4,863,091, dated Sep. 5, 1989, served by Global Tubing, LLC on Apr. 12, 2021 as Nos. GT0012833-GT0012842 in *Global Tubing, LLC* vs. *Tenaris Coiled Tubes, LLC et al.*, case No. 4:17-cv-03299 in the United States District Court for the Southern District of Texas, Houston Division, 10 pages.

U.S. Pat. No. 5,191,911, dated Mar. 9, 1993, served by Global Tubing, LLC on Apr. 12, 2021 as Nos. GT0012843-GT0012851 in *Global Tubing, LLC* vs. *Tenaris Coiled Tubes, LLC et al.*, case No. 4:17-cv-03299 in the United States District Court for the Southern District of Texas, Houston Division, 9 pages.

U.S. Pat. No. 9,234,254, dated Jan. 12, 2016, served by Global Tubing, LLC on Apr. 12, 2021 as Nos. GT0012852-GT00 12865 in *Global Tubing, LLC* vs. *Tenaris Coiled Tubes, LLC et al.*, case No. 4:17-cv-03299 in the United States District Court for the Southern District of Texas, Houston Division, 14 pages.

(56) References Cited

OTHER PUBLICATIONS

U.S. Pat. No. 9,708,681, dated Jul. 18, 2017, served by Global Tubing, LLC on Apr. 12, 2021 as Nos. GT0012866-GT0012878 in *Global Tubing, LLC* vs. *Tenaris Coiled Tubes, LLC et al.*, case No. 4:17-cv-03299 in the United States District Court for the Southern District of Texas, Houston Division, 13 pages.
European Publication EP 2447386 A1, May 2, 2012, served by Global Tubing, LLC on Apr. 12, 2021 as Nos. GT0012879-GT0012903 in *Global Tubing, LLC* vs. *Tenaris Coiled Tubes, LLC et al.*, case No. 4:17-cv-03299 in the United States District Court for the Southern District of Texas, Houston Division, 25 pages.
Mahallawi et al., "Influence of Heat Input and Post-Weld Heat Treatment on Boiler Steel P91 (9Cr-1Mo-V-Nb) Weld Joints, I. Microstructure", Mar. 2013, served by Global Tubing, LLC on Apr. 12, 2021 as Nos. GT0012904-GT0012913 in *Global Tubing, LLC* vs. *Tenaris Coiled Tubes, LLC et al.*, case No. 4:17-cv-03299 in the United States District Court for the Southern District of Texas, Houston Division, 10 pages.
U.S. Pat. No. 2,586,041, dated Feb. 19, 1952, served by Global Tubing, LLC on Apr. 12, 2021 as Nos. GT0012914-GT0012915 in *Global Tubing, LLC* vs. *Tenaris Coiled Tubes, LLC et al.*, case No. 4:17-cv-03299 in the United States District Court for the Southern District of Texas, Houston Division, 2 pages.
Johnson et al., "Toughness of Tempered Upper and Lower Bainitic Microstructures in a 4150 Steel", 1993, served by Global Tubing, LLC on Apr. 12, 2021 as Nos. GT0012916-GT0012924 in *Global Tubing, LLC* vs. *Tenaris Coiled Tubes, LLC et al.*, case No. 4:17-cv-03299 in the United States District Court for the Southern District of Texas, Houston Division, 9 pages.
U.S. Pat. No. 6,267,828, dated Jul. 31, 2001, served by Global Tubing, LLC on Apr. 12, 2021 as Nos. GT0012967-GT0012977 in *Global Tubing, LLC* vs. *Tenaris Coiled Tubes, LLC et al.*, case No. 4:17-cv-03299 in the United States District Court for the Southern District of Texas, Houston Division, 11 pages.
Lawrynowicz et al., "Features of Bainite Transformation in Steels", published Nov. 2002, served by Global Tubing, LLC on Apr. 12, 2021 as Nos. GT0012978-GT0013005 in *Global Tubing, LLC* vs. *Tenaris Coiled Tubes, LLC et al.*, case No. 4:17-cv-03299 in the United States District Court for the Southern District of Texas, Houston Division, 28 pages.
Peet et al., "Fatigue of Extremely Fine Bainite", published in 2011 served by Global Tubing, LLC on Apr. 12, 2021 as Nos. GT0013042-GT0013046 in *Global Tubing, LLC* vs. *Tenaris Coiled Tubes, LLC et al.*, case No. 4:17-cv-03299 in the United States District Court for the Southern District of Texas, Houston Division, 5 pages.
United States Publication No. 2011/0259482 A1, dated Oct. 27, 2011, served by Global Tubing, LLC on Apr. 12, 2021 as Nos. GT0013047-GT0013053 in *Global Tubing, LLC* vs. *Tenaris Coiled Tubes, LLC et al.*, case No. 4:17-cv-03299 in the United States District Court for the Southern District of Texas, Houston Division, 7 pages.
U.S. Pat. No. 4,461,657, dated Jul. 24, 1984, served by Global Tubing, LLC on Apr. 12, 2021 as Nos. GT0013054-GT0013065 in *Global Tubing, LLC* vs. *Tenaris Coiled Tubes, LLC et al.*, case No. 4:17-cv-03299 in the United States District Court for the Southern District of Texas, Houston Division, 12 pages.
SAE International, Surface Vehicle Standard J404, "Chemical Compositions of SAE Alloy Steels", Feb. 1991, served by Global Tubing, LLC on Apr. 12, 2021 as Nos. GT0013066-GT0013072 in *Global Tubing, LLC* vs. *Tenaris Coiled Tubes, LLC et al.*, case No. 4:17-cv-03299 in the United States District Court for the Southern District of Texas, Houston Division, 7 pages.
Charbonnier et al., "Sulfide Stress Cracking of High Strength Modified Cr—Mo Steels", published May 1985, served by Global Tubing, LLC on Apr. 12, 2021 as Nos. GT0013073-GT0013082 in *Global Tubing, LLC* vs. *Tenaris Coiled Tubes, LLC et al.*, case No. 4:17-cv-03299 in the United States District Court for the Southern District of Texas, Houston Division, 10 pages.
Craig, Bruce D., "Oilfield Metallurgy and Corrosion", Third Edition, published in 1993, served by Global Tubing, LLC on Apr. 12, 2021 as Nos. GT0013083-GT0013375 in *Global Tubing, LLC* vs. *Tenaris Coiled Tubes, LLC et al.*, case No. 4:17-cv-03299 in the United States District Court for the Southern District of Texas, Houston Division, 293 pages.
Wang et al., "Study of High Strength Pipeline Steels with Different Microstructures", 2009, served by Global Tubing, LLC on Apr. 12, 2021 as Nos. GT0013376-GT0013382 in *Global Tubing, LLC* vs. *Tenaris Coiled Tubes, LLC et al.*, case No. 4:17-cv-03299 in the United States District Court for the Southern District of Texas, Houston Division, 7 pages.
Rak et al., "Weldability and Toughness Assessment of Ti-Macroalloyed Offshore Steel", published Jan. 1997, served by Global Tubing, LLC on Apr. 12, 2021 as Nos. GT0013383-GT0013390 in *Global Tubing, LLC* vs. *Tenaris Coiled Tubes, LLC et al.*, case No. 4:17-cv-03299 in the United States District Court for the Southern District of Texas, Houston Division, 8 pages.
Goodall, Graeme Robertson, "Welding High Strength Modern Line Pipe Steel", 2011, served by Global Tubing, LLC on Apr. 12, 2021 as Nos. GT0013391-GT0013603 in *Global Tubing, LLC* vs. *Tenaris Coiled Tubes, LLC et al.*, case No. 4:17-cv-03299 in the United States District Court for the Southern District of Texas, Houston Division, 213 pages.
Cayard et al., "Serviceability of Coiled Tubing for Sour Oil and Gas Wells" 1996, served by Global Tubing, LLC on Apr. 12, 2021 as Nos. GT0013604-GT0013622 in *Global Tubing, LLC* vs. *Tenaris Coiled Tubes, LLC et al.*, case No. 4:17-cv-03299 in the United States District Court for the Southern District of Texas, Houston Division, 19 pages.
Maurer Engineering Inc., "Coiled-Tubing Technology (1995-1998)", Apr. 1998, served by Global Tubing, LLC on Apr. 12, 2021 as Nos. GT0013623-GT0014082 in *Global Tubing, LLC* vs. *Tenaris Coiled Tubes, LLC et al.*, case No. 4:17-cv-03299 in the United States District Court for the Southern District of Texas, Houston Division, 460 pages.
Cayard et al., "SPE 38410: Serviceability of Coiled Tubing for Sour Oil and Gas Wells", 1997, served by Global Tubing, LLC on Apr. 12, 2021 as Nos. GT0014083-GT0014097 in *Global Tubing, LLC* vs. *Tenaris Coiled Tubes, LLC et al.*, case No. 4:17-cv-03299 in the United States District Court for the Southern District of Texas, Houston Division, 15 pages.
NACE International, NACE Standard TM0177-96 Item No. 21212, "Standard Test Method—Laboratory Testing of Metals for Resistance to Specific Forms of Environmental Cracking in H2S Environments", publication date unknown, served by Global Tubing, LLC on Apr. 12, 2021 as Nos. GT0014098-GT0014132 in *Global Tubing, LLC* vs. *Tenaris Coiled Tubes, LLC et al.*, case No. 4:17-cv-03299 in the United States District Court for the Southern District of Texas, Houston Division, 35 pages.
NACE International, NACE Standard MR0175-93 Item No. 53024, "Standard Material Requirements—Sulfide Stress Cracking Resistant Metallic Materials for Oilfield Equipment", publication date unknown, served by Global Tubing, LLC on Apr. 12, 2021 as Nos. GT0014133-GT0014160 in *Global Tubing, LLC* vs. *Tenaris Coiled Tubes, LLC et al.*, case No. 4:17-cv-03299 in the United States District Court for the Southern District of Texas, Houston Division, 28 pages.
Bramfitt et al., "Metallography and Microstructures of Carbon and Low-Alloy Steels", ASM Handbook, vol. 9: Metallography and Microstructures, 2004, served by Global Tubing, LLC on Apr. 12, 2021 as Nos. GT0014161-GT0014179 in *Global Tubing, LLC* vs. *Tenaris Coiled Tubes, LLC et al.*, case No. 4:17-cv-03299 in the United States District Court for the Southern District of Texas, Houston Division, 19 pages.
U.S. Pat. No. 5,374,322, dated Dec. 20, 1994, served by Global Tubing, LLC on Apr. 12, 2021 as Nos. GT0022740-GT0022752 in *Global Tubing, LLC* vs. *Tenaris Coiled Tubes, LLC et al.*, case No. 4:17-cv-03299 in the United States District Court for the Southern District of Texas, Houston Division, 13 pages.
United States Publication No. 2012/0199255 A1, dated Aug. 9, 2012, served by Global Tubing, LLC on Apr. 12, 2021 as Nos. GT0022819-GT0022846 in *Global Tubing, LLC* vs. *Tenaris Coiled*

(56) References Cited

OTHER PUBLICATIONS

*Tubes, LLC et al.*, case No. 4:17-cv-03299 in the United States District Court for the Southern District of Texas, Houston Division, 28 pages.
United States Publication No. 2005/0217768 A1, dated Oct. 6, 2005, served by Global Tubing, LLC on Apr. 12, 2021 as Nos. GT0022847-GT0022858 in *Global Tubing, LLC* vs. *Tenaris Coiled Tubes, LLC et al.*, case No. 4:17-cv-03299 in the United States District Court for the Southern District of Texas, Houston Division, 12 pages.
Ruglic et al., "Normalizing of Steel", ASM Handbook, vol. 4, Heat Treating, publication date unknown, served by Global Tubing, LLC on Apr. 12, 2021 as Nos. GT0022892-GT0022902 in *Global Tubing, LLC* vs. *Tenaris Coiled Tubes, LLC et al.*, case No. 4:17-cv-03299 in the United States District Court for the Southern District of Texas, Houston Division, 11 pages.
Ericsson, Torsten, "Principles of Heat Treating of Steels", ASM Handbook, vol. 4, Heat Treating, publication date unknown, served by Global Tubing, LLC on Apr. 12, 2021 as Nos. GT0022903-GT0022923 in *Global Tubing, LLC* vs. *Tenaris Coiled Tubes, LLC et al.*, case No. 4:17-cv-03299 in the United States District Court for the Southern District of Texas, Houston Division, 21 pages.
Kirkaldy, J.S., "Quantitative Prediction of Transformation Hardening in Steels", ASM Handbook, vol. 4, Heat Treating, published in 1991, served by Global Tubing, LLC on Apr. 12, 2021 as Nos. GT0022924-GT0022940 in *Global Tubing, LLC* vs. *Tenaris Coiled Tubes, LLC et al.*, case No. 4:17-cv-03299 in the United States District Court for the Southern District of Texas, Houston Division, 17 pages..
Bates, et al., "Quenching of Steel", ASM Handbook, vol. 4, Heat Treating, published in 1993, served by Global Tubing, LLC on Apr. 12, 2021 as Nos. GT0022941-GT0022998 in *Global Tubing, LLC* vs. *Tenaris Coiled Tubes, LLC et al.*, case No. 4:17-cv-03299 in the United States District Court for the Southern District of Texas, Houston Division, 58 pages.
Canonico, Domenic A., "Stress-Relief Heat Treating of Steel", ASM Handbook, vol. 4, Heat Treating, publication date unknown, served by Global Tubing, LLC on Apr. 12, 2021 as Nos. GT0022999-GT0023004 in *Global Tubing, LLC* vs. *Tenaris Coiled Tubes, LLC et al.*, case No. 4:17-cv-03299 in the United States District Court for the Southern District of Texas, Houston Division, 6 pages.
Welding Handbook, 9th Edition, vol. 4, Materials and Applications, Part 1, published 2011, served by Global Tubing, LLC on Apr. 12, 2021 as Nos. GT0023025-GT0023884 in *Global Tubing, LLC* vs. *Tenaris Coiled Tubes, LLC et al.*, case No. 4:17-cv-03299 in the United States District Court for the Southern District of Texas, Houston Division, 860 pages.
Chitwood et al., "OTC 7032 High-Strength Coiled Tubing Expands Service Capabilities", 1992, served by Global Tubing, LLC on Apr. 12, 2021 as Nos. GT0023898-GT0023913 in *Global Tubing, LLC* vs. *Tenaris Coiled Tubes, LLC et al.*, case No. 4:17-cv-03299 in the United States District Court for the Southern District of Texas, Houston Division, 16 pages.
Coiled Tubing Times, ISSN 1817-3330, Dec. 2012, served by Global Tubing, LLC on Apr. 12, 2021 as Nos. GT0024848-GT0024973 in *Global Tubing, LLC* vs. *Tenaris Coiled Tubes, LLC et al.*, case No. 4:17-cv-03299 in the United States District Court for the Southern District of Texas, Houston Division, 126 pages.
International Coiled Tubing Association, "An Introduction to Coiled Tubing", 2004, served by Global Tubing, LLC on Apr. 12, 2021 as Nos. GT0024985-GT0025016 in *Global Tubing, LLC* vs. *Tenaris Coiled Tubes, LLC et al.*, case No. 4:17-cv-03299 in the United States District Court for the Southern District of Texas, Houston Division, 32 pages.
English translation of Japanese Publication No. 2000-282144, Oct. 10, 2000, served by Global Tubing, LLC on Apr. 12, 2021 as Nos. GT0025063-GT0025073 in *Global Tubing, LLC* vs. *Tenaris Coiled Tubes, LLC et al.*, case No. 4:17-cv-03299 in the United States District Court for the Southern District of Texas, Houston Division, 11 pages.
English translation of Japanese Publication No. S58-19439, Feb. 2, 1983, served by Global Tubing, LLC on Apr. 12, 2021 as Nos. GT0025074-GT0025083 in *Global Tubing, LLC* vs. *Tenaris Coiled Tubes, LLC et al.*, case No. 4:17-cv-03299 in the United States District Court for the Southern District of Texas, Houston Division, 10 pages.
English translation of Chinese Publication No. 101602079 B, May 4, 2011, served by Global Tubing, LLC on Apr. 12, 2021 as Nos. GT0025109-GT0025131 in *Global Tubing, LLC* vs. *Tenaris Coiled Tubes, LLC et al.*, case No. 4:17-cv-03299 in the United States District Court for the Southern District of Texas, Houston Division, 23 pages.
Makela, Weldon, "Heat Treating Basics", Jul. 26, 2012, served by Global Tubing, LLC on Apr. 12, 2021 as Nos. GT0025132-GT0025167 in *Global Tubing, LLC* vs. *Tenaris Coiled Tubes, LLC et al.*, case No. 4:17-cv-03299 in the United States District Court for the Southern District of Texas, Houston Division, 36 pages.
U.S. Pat. No. 6,136,109, dated Oct. 24, 2000, served by Global Tubing, LLC on Apr. 12, 2021 as Nos. GT0025168-GT0025175 in *Global Tubing, LLC* vs. *Tenaris Coiled Tubes, LLC et al.*, case No. 4:17-cv-03299 in the United States District Court for the Southern District of Texas, Houston Division, 8 pages.
United States Publication No. 2005/0034795 A1, dated Feb. 17, 2005, served by Global Tubing, LLC on Apr. 12, 2021 as Nos. GT0025176-GT0025187 in *Global Tubing, LLC* vs. *Tenaris Coiled Tubes, LLC et al.*, case No. 4:17-cv-03299 in the United States District Court for the Southern District of Texas, Houston Division, 12 pages.
NACE International, NACE Standard MR0175-2002 Item No. 21304, "Standard Material Requirements—Sulfide Stress Cracking Resistant Metallic Materials for Oilfield Equipment", publication date unknown, served by Global Tubing, LLC on Apr. 12, 2021 as Nos. GT0025188-GT0025227 in *Global Tubing, LLC* vs. *Tenaris Coiled Tubes, LLC et al.*, case No. 4:17-cv-03299 in the United States District Court for the Southern District of Texas, Houston Division, 40 pages.
NACE International, NACE Standard MR0175-2003 Item No. 21302, "Standard Material Requirements—Metals for Sulfide Stress Cracking and Stress Corrosion Cracking Resistance in Sour Oilfield Environments", publication date unknown, served by Global Tubing, LLC on Apr. 12, 2021 as Nos. GT0025228-GT0025271 in *Global Tubing, LLC* vs. *Tenaris Coiled Tubes, LLC et al.*, case No. 4:17-cv-03299 in the United States District Court for the Southern District of Texas, Houston Division, 44 pages.
Ogden, Becky L., "Sulfide Stress Cracking—Practical Application to the Oil and Gas Industry", 2005, served by Global Tubing, LLC on Apr. 12, 2021 as Nos. GT0025272-GT0025286 in *Global Tubing, LLC* vs. *Tenaris Coiled Tubes, LLC et al.*, case No. 4:17-cv-03299 in the United States District Court for the Southern District of Texas, Houston Division, 15 pages.
Canadian Publication No. CA 2414822 A1, Jun. 18, 2004, served by Global Tubing, LLC on Apr. 12, 2021 as Nos. GT0025287-GT0025322 in *Global Tubing, LLC* vs. *Tenaris Coiled Tubes, LLC et al.*, case No. 4:17-cv-03299 in the United States District Court for the Southern District of Texas, Houston Division, 36 pages.
U.S. Pat. No. 7,048,811, dated May 23, 2006, served by Global Tubing, LLC on Apr. 12, 2021 as Nos. GT0025323-GT0025329 in *Global Tubing, LLC* vs. *Tenaris Coiled Tubes, LLC et al.*, case No. 4:17-cv-03299 in the United States District Court for the Southern District of Texas, Houston Division, 7 pages.
Grossmann et al., "Principles of Heat Treatment—Fifth Edition", American Society for Metals, Apr. 1971, served by Global Tubing, LLC on Apr. 12, 2021 as Nos. GT0025330-GT0025645 in *Global Tubing, LLC* vs. *Tenaris Coiled Tubes, LLC et al.*, case No. 4:17-cv-03299 in the United States District Court for the Southern District of Texas, Houston Division, 316 pages.
United States Publication No. 2008/0226491 A1, dated Sep. 19, 2008, served by Global Tubing, LLC on Apr. 12, 2021 as Nos. GT0025646-GT0025657 in *Global Tubing, LLC* vs. *Tenaris Coiled Tubes, LLC et al.*, case No. 4:17-cv-03299 in the United States District Court for the Southern District of Texas, Houston Division, 12 pages.

(56) References Cited

OTHER PUBLICATIONS

United States Publication No. 2008/0302452 A1, dated Dec. 11, 2008, served by Global Tubing, LLC on Apr. 12, 2021 as Nos. GT0025658-GT0025661 in *Global Tubing, LLC* vs. *Tenaris Coiled Tubes, LLC et al.*, case No. 4:17-cv-03299 in the United States District Court for the Southern District of Texas, Houston Division, 4 pages.
U.S. Pat. No. 4,533,405, dated Aug. 6, 1985, served by Global Tubing, LLC on Apr. 12, 2021 as Nos. GT0025662-GT0025698 in *Global Tubing, LLC* vs. *Tenaris Coiled Tubes, LLC et al.*, case No. 4:17-cv-03299 in the United States District Court for the Southern District of Texas, Houston Division, 37 pages.
U.S. Pat. No. 6,217,676, dated Apr. 17, 2001, served by Global Tubing, LLC on Apr. 12, 2021 as Nos. GT0025699-GT0025706 in *Global Tubing, LLC* vs. *Tenaris Coiled Tubes, LLC et al.*, case No. 4:17-cv-03299 in the United States District Court for the Southern District of Texas, Houston Division, 8 pages.
English translation of Japanese Publication No. H06-116645, Apr. 26, 1994, served by Global Tubing, LLC on Apr. 12, 2021 as Nos. GT0025707-GT0025730 in *Global Tubing, LLC* vs. *Tenaris Coiled Tubes, LLC et al.*, case No. 4:17-cv-03299 in the United States District Court for the Southern District of Texas, Houston Division, 24 pages.
English translation of Japanese Patent Publication No. H09-201688, Aug. 5, 1997, served by Global Tubing, LLC on Apr. 12, 2021 as Nos. GT0025731-GT0025748 in *Global Tubing, LLC* vs. *Tenaris Coiled Tubes, LLC et al.*, case No. 4:17-cv-03299 in the United States District Court for the Southern District of Texas, Houston Division, 18 pages.
Turconi, et al., "Improvement of Resistance to SCC Initiation and Propagation of High Strength OCTG Through Microstructure and Precipitation Control", Paper No. 01077, Corrosion 2001, 2001, served by Global Tubing, LLC on Apr. 12, 2021 as Nos. GT0025769-GT0025783 in *Global Tubing, LLC* vs. *Tenaris Coiled Tubes, LLC et al.*, case No. 4:17-cv-03299 in the United States District Court for the Southern District of Texas, Houston Division, 15 pages.
ASM International, Practical Heat Treating, Second Edition (#05144G), "Chapter 2—Fundamentals of the Heat Treating of Steel", 2006, served by Global Tubing, LLC on Apr. 12, 2021 as Nos. GT0035357-GT0035374 in *Global Tubing, LLC* vs. *Tenaris Coiled Tubes, LLC et al.*, case No. 4:17-cv-03299 in the United States District Court for the Southern District of Texas, Houston Division, 18 pages.
Davis, J.R., Metals Handbook—Desk Edition, Second Edition, pp. 32, 61, 1471, 1517, and 103, published in 1998, served by Global Tubing, LLC on Apr. 12, 2021 as Nos. GT0051499-GT0051506 in *Global Tubing, LLC* vs. *Tenaris Coiled Tubes, LLC et al.*, case No. 4:17-cv-03299 in the United States District Court for the Southern District of Texas, Houston Division, 8 pages.
Arai, et al., ASM Handbook, vol. 4—Heat Treating, 1994, served by Global Tubing, LLC on Apr. 12, 2021 as Nos. GT0130869-GT0131868 in *Global Tubing, LLC* vs. *Tenaris Coiled Tubes, LLC et al.*, case No. 4:17-cv-03299 in the United States District Court for the Southern District of Texas, Houston Division, 1000 pages.
"SeaCAT LP—Specification for SeaCAT 100 Umbilical Tubing Continuous Anode Technology", <http://seacatcorp.com/SeaCat 100 Tubing spec Rev 5 Jul. 1, 2003.htm>, dated Nov. 14, 2004, served by Global Tubing, LLC on Apr. 12, 2021 as Nos. GT0210506-GT0210510 in *Global Tubing, LLC* vs. *Tenaris Coiled Tubes, LLC et al.*, case No. 4:17-cv-03299 in the United States District Court for the Southern District of Texas, Houston Division, 5 pages.
"Specification for Coiled Tubing—U.S. Customary and SI Units", API Specification 5ST, First Edition, Apr. 2010, served by Global Tubing, LLC on Apr. 12, 2021 as Nos. GT0224055-GT0224129 in *Global Tubing, LLC* vs. *Tenaris Coiled Tubes, LLC et al.*, case No. 4:17-cv-03299 in the United States District Court for the Southern District of Texas, Houston Division, 75 pages.
English translation of Chinese Publication No. CN 101898295 A, Dec. 1, 2010, served by Global Tubing, LLC on Apr. 12, 2021 as Nos. GT0283198-GT0283211 in *Global Tubing, LLC* vs. *Tenaris Coiled Tubes, LLC et al.*, case No. 4:17-cv-03299 in the United States District Court for the Southern District of Texas, Houston Division, 14 pages.
ASTM International, Designation A 255-02, "Standard Test Methods for Determining Hardenability of Steel", publication date unknown, served by Global Tubing, LLC on Apr. 12, 2021 as Nos. GT0283245-GT0283268 in *Global Tubing, LLC* vs. *Tenaris Coiled Tubes, LLC et al.*, case No. 4:17-cv-03299 in the United States District Court for the Southern District of Texas, Houston Division, 24 pages.
Newman, Kenneth R, SPE163884, "Development of a New CT Life Tracking Process", SPE International, 2013, served by Global Tubing, LLC on Apr. 12, 2021 as Nos. GT0283277-GT0283288 in *Global Tubing, LLC* vs. *Tenaris Coiled Tubes, LLC et al.*, case No. 4:17-cv-03299 in the United States District Court for the Southern District of Texas, Houston Division, 12 pages.
Coloschi et al., SPE163930, "A Metallurgical Look at Coiled Tubing", SPE International, 2013, served by Global Tubing, LLC on Apr. 12, 2021 as Nos. GT0283289-GT0283297 in *Global Tubing, LLC* vs. *Tenaris Coiled Tubes, LLC et al.*, case No. 4:17-cv-03299 in the United States District Court for the Southern District of Texas, Houston Division, 9 pages.
Seal et al., SPE 173660, "A Field Case History of Sulfate Reducing Bacteria Attack on Coiled Tubing Bias Welds—Root Causes and Remediation", SPE International, 2015, served by Global Tubing, LLC on Apr. 12, 2021 as Nos. GT0283298-GT0283313 in *Global Tubing, LLC* vs. *Tenaris Coiled Tubes, LLC et al.*, case No. 4:17-cv-03299 in the United States District Court for the Southern District of Texas, Houston Division, 16 pages.
Padron et al., SPE-179045-MS, "CT100+ Bias Weld Fatigue Life Estimations—Are Adjustments Required", SPE International, 2016, served by Global Tubing, LLC on Apr. 12, 2021 as Nos. GT0283314-GT0283332 in *Global Tubing, LLC* vs. *Tenaris Coiled Tubes, LLC et al.*, case No. 4:17-cv-03299 in the United States District Court for the Southern District of Texas, Houston Division, 19 pages.
Trzaska et al., "The calculation of CCT diagrams for engineering steels", Archives of Materials Science and Engineering, vol. 39, Issue 1, Sep. 2009, served by Global Tubing, LLC on Apr. 12, 2021 as Nos. GT0283333-GT0283340 in *Global Tubing, LLC* vs. *Tenaris Coiled Tubes, LLC et al.*, case No. 4:17-cv-03299 in the United States District Court for the Southern District of Texas, Houston Division, 8 pages.
Saunders et al., "Using JMatPro to Model Materials Properties and Behavior", Dec. 2003, served by Global Tubing, LLC on Apr. 12, 2021 as Nos. GT0283341-GT0283346 in *Global Tubing, LLC* vs. *Tenaris Coiled Tubes, LLC et al.*, case No. 4:17-cv-03299 in the United States District Court for the Southern District of Texas, Houston Division, 6 pages.
Zhao, J.-C., Methods for Phase Diagram Determination, published in 2011, served by Global Tubing, LLC on Apr. 12, 2021 as Nos. GT0283347-GT0283863 in *Global Tubing, LLC* vs. *Tenaris Coiled Tubes, LLC et al.*, case No. 4:17-cv-03299 in the United States District Court for the Southern District of Texas, Houston Division, 517 pages.
Campbell, F.C., "Alloy Steels", Chapter 20, Elements of Metallurgy and Engineering Alloys, first printing Jun. 2008, served by Global Tubing, LLC on Apr. 12, 2021 as Nos. GT0283864-GT0283867 in *Global Tubing, LLC* vs. *Tenaris Coiled Tubes, LLC et al.*, case No. 4:17-cv-03299 in the United States District Court for the Southern District of Texas, Houston Division, 4 pages.
API Specification 5L, Specification for Line Pipe, 45th Edition, Jul. 2013, served by Global Tubing, LLC on Apr. 12, 2021 as Nos. GT0283868-GT0284059 in *Global Tubing, LLC* vs. *Tenaris Coiled Tubes, LLC et al.*, case No. 4:17-cv-03299 in the United States District Court for the Southern District of Texas, Houston Division, 192 pages.
ASTM International, Designation: E112-12, "Standard Test Methods for Determining Average Grain Size", publication date unknown, served by Global Tubing, LLC on Apr. 12, 2021 as Nos. GT0284060-GT0284086 in *Global Tubing, LLC* vs. *Tenaris Coiled Tubes, LLC et al.*, case No. 4:17-cv-03299 in the United States District Court for the Southern District of Texas, Houston Division, 27 pages.
Gauthier, Michelle M., "Glossary of Terms", Engineered Materials Handbook Desk Edition, 1995, served by Global Tubing, LLC on

(56) References Cited

OTHER PUBLICATIONS

Apr. 12, 2021 as Nos. GT0284087-GT0284156 in *Global Tubing, LLC* vs. *Tenaris Coiled Tubes, LLC et al.*, case No. 4:17-cv-03299 in the United States District Court for the Southern District of Texas, Houston Division, 70 pages.
Burner, Jr., Harold, "Hardenability of Carbon and Low-Alloy Steels", ASM Handbook, vol. 1: Properties and Selection: Irons, Steels, and High-Performance Alloys, 1990, served by Global Tubing, LLC on Apr. 12, 2021 as Nos. GT0284157-GT0284177 in *Global Tubing, LLC* vs. *Tenaris Coiled Tubes, LLC et al.*, case No. 4:17-cv-03299 in the United States District Court for the Southern District of Texas, Houston Division, 21 pages.
"High-Strength Structural and High-Strength Low-Alloy Steels", ASM Handbook, vol. 1: Properties and Selection: Irons, Steels, and High- Performance Alloys, 1990, served by Global Tubing, LLC on Apr. 12, 2021 as Nos. GT0284178-GT0284212 in *Global Tubing, LLC* vs. *Tenaris Coiled Tubes, LLC et al.*, case No. 4:17-cv-03299 in the United States District Court for the Southern District of Texas, Houston Division, 35 pages.
Kraus, George, "Microstructures, Processing, and Properties of Steels", ASM Handbook, vol. 1: Properties and Selection: Irons, Steels, and High-Performance Alloys, 1990, served by Global Tubing, LLC on Apr. 12, 2021 as Nos. GT0284213-GT0284226 in *Global Tubing, LLC* vs. *Tenaris Coiled Tubes, LLC et al.*, case No. 4:17-cv-03299 in the United States District Court for the Southern District of Texas, Houston Division, 14 pages.
Liu et al., "Weldability of Steels", ASM Handbook vol. 1: Properties and Selection: Irons, Steels, and High-Performance Alloys, 1990, served by Global Tubing, LLC on Apr. 12, 2021 as Nos. GT0284227-GT0284237 in *Global Tubing, LLC* vs. *Tenaris Coiled Tubes, LLC et al.*, case No. 4:17-cv-03299 in the United States District Court for the Southern District of Texas, Houston Division, 11 pages.
"Fracture Mechanics Properties of Carbon and Alloy Steels", ASM Handbook, vol. 19: Fatigue and Fracture, 1996, served by Global Tubing, LLC on Apr. 12, 2021 as No. GT0284238-GT0284278 in *Global Tubing, LLC* vs. *Tenaris Coiled Tubes, LLC et al.*, case No. 4:17-cv-03299 in the United States District Court for the Southern District of Texas, Houston Division, 41 pages.
Landes, John D., "Fracture Toughness Testing", ASM Handbook, vol. 19: Fatigue and Fracture, 1996, served by Global Tubing, LLC on Apr. 12, 2021 as Nos. GT0284279-GT0284295 in *Global Tubing, LLC* vs. *Tenaris Coiled Tubes, LLC et al.*, case No. 4:17-cv-03299 in the United States District Court for the Southern District of Texas, Houston Division, 17 pages.
Antolovich, Stephen D., "Alloy Design for Fatigue and Fracture", ASM Handbook, vol. 19: Fatigue and Fracture, 1996, served by Global Tubing, LLC on Apr. 12, 2021 as Nos. GT0284296-GT0284310 in *Global Tubing, LLC* vs. *Tenaris Coiled Tubes, LLC et al.*, case No. 4:17-cv-03299 in the United States District Court for the Southern District of Texas, Houston Division, 15 pages.
"Software for Computational Materials Modeling and Simulation", ASM Handbook, vol. 22B, Metals Process Simulation, 2010, served by Global Tubing, LLC on Apr. 12, 2021 as Nos. GT0284311-GT0284318 in *Global Tubing, LLC* vs. *Tenaris Coiled Tubes, LLC et al.*, case No. 4:17-cv-03299 in the United States District Court for the Southern District of Texas, Houston Division, 8 pages.
"Introduction to Steel Heat Treatment", ASM Handbook, vol. 4A, Steel Heat Treating Fundamentals and Processes, 2013, served by Global Tubing, LLC on Apr. 12, 2021 as Nos. GT0284319-GT0284341 in *Global Tubing, LLC* vs. *Tenaris Coiled Tubes, LLC et al.*, case No. 4:17-cv-03299 in the United States District Court for the Southern District of Texas, Houston Division, 23 pages.
Chen et al., "Influence of Welding on Steel Weldment Properties", ASM Handbook, vol. 6: Welding, Brazing, and Soldering, 1993, served by Global Tubing, LLC on Apr. 12, 2021 as Nos. GT0284342-GT0284354 in *Global Tubing, LLC* vs. *Tenaris Coiled Tubes, LLC et al.*, case No. 4:17-cv-03299 in the United States District Court for the Southern District of Texas, Houston Division, 13 pages.
Somers, Bruce R., "Introduction to the Selection of Carbon and Low-Alloy Steels", ASM Handbook, vol. 6: Welding, Brazing, and Soldering, 1993, served by Global Tubing, LLC on Apr. 12, 2021 as Nos. GT0284355-GT0284357 in *Global Tubing, LLC* vs. *Tenaris Coiled Tubes, LLC et al.*, case No. 4:17-cv-03299 in the United States District Court for the Southern District of Texas, Houston Division, 3 pages.
Dupont, John N., "Fundamentals of Weld Solidification", ASM Handbook, vol. 6A, Welding Fundamentals and Processes, 2011, served by Global Tubing, LLC on Apr. 12, 2021 as Nos. GT0284358-GT0284376 in *Global Tubing, LLC* vs. *Tenaris Coiled Tubes, LLC et al.*, case No. 4:17-cv-03299 in the United States District Court for the Southern District of Texas, Houston Division, 19 pages.
Maalekian, Mehran, "Solid-State Transformations in Weldments", ASM Handbook, vol. 6A, Welding Fundamentals and Processes, 2011, served by Global Tubing, LLC on Apr. 12, 2021 as Nos. GT0284377-GT0284400 in *Global Tubing, LLC* vs. *Tenaris Coiled Tubes, LLC et al.*, case No. 4:17-cv-03299 in the United States District Court for the Southern District of Texas, Houston Division, 24 pages.
"Fracture Toughness and Fracture Mechanics", ASM Handbook, vol. 8: Mechanical Testing and Evaluation, 2000, served by Global Tubing, LLC on Apr. 12, 2021 as Nos. GT0284401-GT0284413 in *Global Tubing, LLC* vs. *Tenaris Coiled Tubes, LLC et al.*, case No. 4:17-cv-03299 in the United States District Court for the Southern District of Texas, Houston Division, 13 pages.
"Impact Toughness Testing", ASM Handbook, vol. 8: Mechanical Testing and Evaluation, 2000, served by Global Tubing, LLC on Apr. 12, 2021 as Nos. GT0284414-GT0284429 in *Global Tubing, LLC* vs. *Tenaris Coiled Tubes, LLC et al.*, case No. 4:17-cv-03299 in the United States District Court for the Southern District of Texas, Houston Division, 16 pages.
Revankar, Gopal, "Introduction to Hardness Testing", Mechanical Testing and Evaluation, vol. 8, ASM Handbook, revised online 2016, served by Global Tubing, LLC on Apr. 12, 2021 as Nos. GT0284430-GT0284442 in *Global Tubing, LLC* vs. *Tenaris Coiled Tubes, LLC et al.*, case No. 4:17-cv-03299 in the United States District Court for the Southern District of Texas, Houston Division, 13 pages.
"Martensitic Structures", ASM Handbook, vol. 9: Metallography and Microstructures, 2004, served by Global Tubing, LLC on Apr. 12, 2021 as Nos. GT0284443-GT0284456 in *Global Tubing, LLC* vs. *Tenaris Coiled Tubes, LLC et al.*, case No. 4:17-cv-03299 in the United States District Court for the Southern District of Texas, Houston Division, 14 pages.
Aliya, Debbie, "Physical Metallurgy Concepts in Interpretation of Microstructures", ASM Handbook, vol. 9: Metallography and Microstructures, 2004, served by Global Tubing, LLC on Apr. 12, 2021 as Nos. GT0284457-GT0284483 in *Global Tubing, LLC* vs. *Tenaris Coiled Tubes, LLC et al.*, case No. 4:17-cv-03299 in the United States District Court for the Southern District of Texas, Houston Division, 27 pages.
Adams et al., SPE 29456, "An Evaluation of Large Diameter Coiled Tubing for Subsurface Production Tubulars", SPE International, 1995, served by Global Tubing, LLC on Apr. 12, 2021 as Nos. GT0284484-GT0284489 in *Global Tubing, LLC* vs. *Tenaris Coiled Tubes, LLC et al.*, case No. 4:17-cv-03299 in the United States District Court for the Southern District of Texas, Houston Division, 6 pages.
U.S. Pat. No. 8,323,560, dated Dec. 4, 2012, served by Global Tubing, LLC on Apr. 12, 2021 as Nos. GT0284490-GT0284501 in *Global Tubing, LLC* vs. *Tenaris Coiled Tubes, LLC et al.*, case No. 4:17-cv-03299 in the United States District Court for the Southern District of Texas, Houston Division, 12 pages.
Transcript of Videotaped Deposition of Philip Lewis, Dec. 15, 2020, as presented in *Global Tubing, LLC* vs. *Tenaris Coiled Tubes, LLC et al.*, case No. 4:17-cv-03299 in the United States District Court for the Southern District of Texas, Houston Division, 12 pages.
Brown, et al., "DEA-97 Coiled Tubing Weld Cycle Life, Joint Industry Project", Part I: Final Project Report, Oct. 26, 1995, produced by Tenaris Coiled Tubes, LLC as Nos. TCT0282964-TCT0283071 in *Global Tubing, LLC* vs. *Tenaris Coiled Tubes, LLC et al.*, case No. 4:17-cv-03299 in the United States District Court for the Southern District of Texas, Houston Division, 108 pages.

(56) References Cited

OTHER PUBLICATIONS

Southwestern Pipe, Inc, "The Development and Testing of Cymax 100 Coiled Tubing", Jan. 1992, produced by Tenaris Coiled Tubes, LLC as Nos. TCT0009962-TCT0009976 in *Global Tubing, LLC* vs. *Tenaris Coiled Tubes, LLC et al.*, case No. 4:17-cv-03299 in the United States District Court for the Southern District of Texas, Houston Division, 15 pages.
Southwestern Pipe, Inc, "Orbital Tig Welding, Cymax Coiled Tubing", Nov. 1992, produced by Tenaris Coiled Tubes, LLC as Nos. TCT0009977-TCT0009989 in *Global Tubing, LLC* vs. *Tenaris Coiled Tubes, LLC et al.*, case No. 4:17-cv-03299 in the United States District Court for the Southern District of Texas, Houston Division, 13 pages.
Southwestern Pipe, Inc, "Southwestern Pipe, Inc., Cymax Division, Coiled Tubing Specifications, Technical Data", Jan. 1, 1993, produced by Tenaris Coiled Tubes, LLC as Nos. TCT0009950-TCT0009961 in *Global Tubing, LLC* vs. *Tenaris Coiled Tubes, LLC et al.*, case No. 4:17-cv-03299 in the United States District Court for the Southern District of Texas, Houston Division, 12 pages.
CYMAX Southwestern Pipe, Inc. Presentation, publication date unknown, produced by Tenaris Coiled Tubes, LLC as Nos. TCT0013999-TCT0014057 in *Global Tubing, LLC* vs. *Tenaris Coiled Tubes, LLC et al.*, case No. 4:17-cv-03299 in the United States District Court for the Southern District of Texas, Houston Division, 57 pages.
Thompson, J.M., "Full Body Quenched and Tempered Coiled Tubing Theory vs. Field Experience", Cymax Division, published Mar. 1, 1994, produced by Tenaris Coiled Tubes, LLC as Nos. TCT0009930-TCT0009989 in *Global Tubing, LLC* vs. *Tenaris Coiled Tubes, LLC et al.*, case No. 4:17-cv-03299 in the United States District Court for the Southern District of Texas, Houston Division, 60 pages.
SeaCAT Corporation Specification for SeaCAT Umbilical Tubing Continuous Anode Technology, published in 2000, produced by Tenaris Coiled Tubes, LLC as Nos. TCT0373809-TCT0373819 in *Global Tubing, LLC* vs. *Tenaris Coiled Tubes, LLC et al.*, case No. 4:17-cv-03299 in the United States District Court for the Southern District of Texas, Houston Division, 11 pages.
SeaCAT 2001 Specification Umbilical Tubing Continuous Anode Technology, published Oct. 1, 2001—Revision 11, produced by Tenaris Coiled Tubes, LLC as Nos. TCT0372656-TCT0372661 in *Global Tubing, LLC* vs. *Tenaris Coiled Tubes, LLC et al.*, case No. 4:17-cv-03299 in the United States District Court for the Southern District of Texas, Houston Division, 6 pages.
SeaCAT Brochure—Coiled Tubing for Subsea Umbilical and Flowline Applications, publication date unknown, produced by Tenaris Coiled Tubes, LLC as Nos. TCT0375105-TCT0375246 in *Global Tubing, LLC* vs. *Tenaris Coiled Tubes, LLC et al.*, case No. 4:17-cv-03299 in the United States District Court for the Southern District of Texas, Houston Division, 142 pages.
SeaCAT Handbook—Coiled Tubing for Subsea Umbilical and Flowline Application, published in Spring 2005, produced by Tenaris Coiled Tubes, LLC as Nos. TCT0372486-TCT0372630 in *Global Tubing, LLC* vs. *Tenaris Coiled Tubes, LLC et al.*, case No. 4:17-cv-03299 in the United States District Court for the Southern District of Texas, Houston Division, 145 pages.
SeaCAT Shell Princess Project—published in Aug. 2002, produced by Tenaris Coiled Tubes, LLC as Nos. TCT0374261-TCT0374534 in *Global Tubing, LLC* vs. *Tenaris Coiled Tubes, LLC et al.*, case No. 4:17-cv-03299 in the United States District Court for the Southern District of Texas, Houston Division, 274 pages.
SeaCAT Process Control, published in 1999, produced by Tenaris Coiled Tubes, LLC as Nos. TCT0374535-TCT0374783 in *Global Tubing, LLC* vs. *Tenaris Coiled Tubes, LLC et al.*, case No. 4:17-cv-03299 in the United States District Court for the Southern District of Texas, Houston Division, 249 pages.
SeaCAT Qualification, published Oct. 4, 2001, produced by Tenaris Coiled Tubes, LLC as Nos. TCT0372729-TCT0372734 in *Global Tubing, LLC* vs. *Tenaris Coiled Tubes, LLC et al.*, case No. 4:17-cv-03299 in the United States District Court for the Southern District of Texas, Houston Division, 6 pages.
Auguston, Rogerio "The Influence of Chemical Composition and Microstructure of API Linepipe Steels on Hydrogen Induced Cracking and Sulfide Stress Corrosion Cracking", Materials Science and Engineering, published in 2003, produced by Tenaris Coiled Tubes, LLC as Nos. TCT0152051-TCT0152057 in *Global Tubing, LLC* vs. *Tenaris Coiled Tubes, LLC et al.*, case No. 4:17-cv-03299 in the United States District Court for the Southern District of Texas, Houston Division, 7 pages.
Faszold, J., SPE0153945 "Full-Scale Fatigue Testing with 130k Yield Tubing", SPE International, published in 2012, produced by Tenaris Coiled Tubes, LLC as Nos. TCT0626230-TCT0626235 in *Global Tubing, LLC* vs. *Tenaris Coiled Tubes, LLC et al.*, case No. 4:17-cv-03299 in the United States District Court for the Southern District of Texas, Houston Division, 6 pages.
Coulomb Status Summary Report published on Oct. 10, 2001, produced by Tenaris Coiled Tubes, LLC as Nos. TCT0372631-TCT0372667 in *Global Tubing, LLC* vs. *Tenaris Coiled Tubes, LLC et al.*, case No. 4:17-cv-03299 in the United States District Court for the Southern District of Texas, Houston Division, 37 pages.
Complaint filed by Global Tubing LLC (with Attachment: #1 Civil Cover Sheet) on Oct. 30, 2017, as pleading No. 1 in case 4:17-cv-03299, *Global Tubing, LLC* vs. *Tenaris Coiled Tubes, LLC et al.*, in the United States District Court for the Southern District of Texas, Houston Division.
First Amended Complaint with Jury Demand against Tenaris Coiled Tubes LLC filed by Global Tubing LLC on Feb. 12, 2018 as pleading No. 19 in case No. 4:17-cv-03299, *Global Tubing, LLC* vs. *Tenaris Coiled Tubes, LLC et al.*, in the United States District Court for the Southern District of Texas, Houston Division.
Answer to 19 Amended Complaint/Counterclaim/Crossclaim etc. by Tenaris Coiled Tubes LLC, filed on Aug. 13, 2018 as pleading No. 36 in case No. 4:17-cv-03299, *Global Tubing, LLC* vs. *Tenaris Coiled Tubes, LLC et al.*, in the United States District Court for the Southern District of Texas, Houston Division.
Supplement to 19 Amended Complaint/Counterclaim/Crossclaim etc., by Global Tubing LLC (with Attachments: #1 Exhibit 1, #2 Exhibit 2, #3 Exhibit 3, #4 Exhibit 4, #5 Exhibit 5) filed on Jan. 29, 2019 as pleading No. 47 in case No. 4:17-cv-03299, *Global Tubing, LLC* vs. *Tenaris Coiled Tubes, LLC et al.*, in the United States District Court for the Southern District of Texas, Houston Division.
Amended Answer to 1 Complaint with Jury Demand, Counterclaim against Global Tubing LLC by Tenaris Coiled Tubes LLC (with Attachment: #1 Exhibit A), filed on Mar. 25, 2019 as pleading No. 57 in case No. 4:17-cv-03299, *Global Tubing, LLC* vs. *Tenaris Coiled Tubes, LLC et al.*, in the United States District Court for the Southern District of Texas, Houston Division.
Supplement to 57 Answer to Complaint, Counterclaim by Tenaris Coiled Tubes LLC filed on Jul. 9, 2019 as pleading No. 71 in case No. 4:17-cv-03299, *Global Tubing, LLC* vs. *Tenaris Coiled Tubes, LLC et al.*, in the United States District Court for the Southern District of Texas, Houston Division.
Second Amended Answer to 57 Answer to Complaint, Counterclaim with Jury Demand, Counterclaim against Global Tubing LLC by Tenaris Coiled Tubes, LLC, filed by Global Tubing, LLC (with Attachments: #1 Exhibit A, #2 Exhibit B, #3 Exhibit C) on Aug. 13, 2019 as pleading No. 74 in case No. 4:17-cv-03299, *Global Tubing, LLC* vs. *Tenaris Coiled Tubes, LLC et al.*, in the United States District Court for the Southern District of Texas, Houston Division.
Third Amended Answer to 74 Amended Answer, Counterclaim, with Jury Demand, Counterclaim against Global Tubing LLC by Tenaris S.A., Tenaris Coiled Tubes LLC (with Attachments: #1 Exhibit A, #2 Exhibit B, #3 Exhibit C) filed on Sep. 30, 2019 as pleading No. 76 in case No. 4:17-cv-03299, *Global Tubing, LLC* vs. *Tenaris Coiled Tubes, LLC et al.*, in the United States District Court for the Southern District of Texas, Houston Division.
Redaction to 80 Sealed Document by Global Tubing LLC [Redacted], filed by Global Tubing, LLC on Dec. 13, 2019 as pleading No. 97 in case No. 4:17-cv-03299, *Global Tubing, LLC* vs. *Tenaris Coiled Tubes, LLC et al.*, in the United States District Court for the Southern District of Texas, Houston Division.

(56) References Cited

OTHER PUBLICATIONS

Redaction to 81 Sealed Document by Global Tubing LLC, filed by Global Tubing, LLC on Jan. 23, 2020 as pleading No. 98 in case No. 4:17-cv-03299, *Global Tubing, LLC* vs. *Tenaris Coiled Tubes, LLC et al.*, in the United States District Court for the Southern District of Texas, Houston Division.
Response to 96 Sealed Document Tenaris' Answer, Affirmative Defenses, and Counterclaims to Second Amended Complaint, filed by Global Tubing LLC on Jan. 31, 2020 as pleading No. 100 in case No. 4:17-cv-03299, *Global Tubing, LLC* vs. *Tenaris Coiled Tubes, LLC et al.*, in the United States District Court for the Southern District of Texas, Houston Division.
Response to Tenaris Coiled Tubes, LLC's Amended Answer and Tenaris SA's Original Answer, Affirmative Defenses, and Counterclaims to Second Amended Complaint re: 119 Sealed Document [Redacted], filed by Global Tubing, LLC on Apr. 29, 2020 as pleading No. 124 in case No. 4:17-cv-03299, *Global Tubing, LLC* vs. *Tenaris Coiled Tubes, LLC et al.*, in the United States District Court for the Southern District of Texas, Houston Division.
Tenaris' Supplemental Answer, Affirmative Defenses, and Counterclaims to Global Tubing's Second Amended Complaint [Redacted], filed by Tenaris Coiled Tubes, LLC and Tenaris S.A. (with #1 Appendix) on May 14, 2020 as pleading No. 129 in case No. 4:17-cv-03299, *Global Tubing, LLC* vs. *Tenaris Coiled Tubes, LLC et al.*, in the United States District Court for the Southern District of Texas, Houston Division.
Memorandum and Order filed on Jun. 22, 2020 as pleading No. 140 in case No. 4:17-cv-03299, *Global Tubing, LLC* vs. *Tenaris Coiled Tubes, LLC et al.*, in the United States District Court for the Southern District of Texas, Houston Division.
[No Author Listed], "Southwestern Pipe, Inc.—Cymax Coiled Tubing," Unknown if this document was publicly disclosed, but dated Jan. 1992, 1 page.
Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.
Anelli, E., D. Colleluori, M. Pontremoli, G. Cumino, A Izquierdo, H. Quintanilla, "Metallurgical design of advanced heavy wall seamless pipes for deep-water applications", 4th International Conference on Pipeline Technology, May 9 to 13, 2004, Ostend, Belgium.
Asahi, et al., Development of Ultra-high-strength Linepipe, X120, Nippon Steel Technical Report, Jul. 2004, Issue 90, pp. 82-87.
ASM Handbook, Mechanical Tubing and Cold Finishing, Metals Handbook Desk Edition, (2000), 5 pages.
ASTM A 182/ A 182M "Standard Specification for Forged or Rolled Alloy and Stainless Steel Pipe Flanges, Forged Fittings, and Valves and Parts for High-Temperature Service."
ASTM A 213/A 213M "Standard Specification for Seamless Ferritic and Austenitic Alloy-Steel Boiler, Superheater, and Heat-Exchanger Tubes."
ASTM A336/A336M "Standard Specification for Alloy Steel Forgings for Pressure and High-Temperature Parts."
ASTM A355 which is related to "Seamless Ferritic Alloy-Steel Pipe for High-Temperature Service".
ASTM, "E112-13 Standard Test Methods for Determining Average Grain Size," ASTM International. 2012. p. 1-28.
Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A, "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Bhadeshia et al., "Steels, Microstructure and Properties," Third Edition, Elsevier, Published in 2006, pp. 296.
Boulegue, Jacques, "Equilibria in a sulfide rich water from Enghien-les-Bains, France", Geochimica et Cosmochimica Acta, Pergamon Press, 1977, vol. 41, pp. 1751-1758, Great Britain.
Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina (Abstract).
Cancio et al., "Characterization of microalloy precipitates in the austenitic range of high strength low alloy steels", Steel Research, 2002, vol. 73, pp. 340-346.
Carboni, A, A Pigani, G. Megahed, S. Paul, Casting and rolling of API X 70 grades for artic application in a thin slab rolling plane, Stahl u Eisen, 2008, N° 1, p. 131-134.
Chang, L.C., ""Microstructures and reaction kinetics of bainite transformation in Si-rich steels,"" XP0024874, Materials Science and Engineering, vol. 368, No. 1-2, Mar. 15, 2004, pp. 175-182, Abstract, Table 1.
Clark, A Horrell, "Some Comments on the Composition and Stability Relations of Mackinawite", Neues Jahrbuch fur Mineralogie, 1966, vol. 5, pp. 300-304, London, England.
Craig, Bruce D., "Effect of Copper on the Protectiveness of Iron Sulfide Films", Corrosion, National Association of Corrosion Engineers, 1984, vol. 40, Issue 9, pp. 471-474.
D.O.T. 178.68 Spec. 39, pp. 831-840, Non reusable (non refillable) cylinders, Oct. 1, 2002.
Davis, J.R., et al. "ASM—Speciality Handbook—Carbon and alloy steels" ASM Speciality Handbook, Carbon and Alloy Steels, 1996, pp. 12-27, XP002364757 US.
De Medicis, Rinaldo, ""Cubic FeS, A Metastable Iron Sulfide"", Science, American Association For The Advancement of Science, Steen bock Memorial Library, Dec. 11, 1970, vol. 170, Issue 3963, pp. 723-728.
Drill Rod Joint Depth Capacity Chart, downloaded Jan. 15, 2013; http://www. boartlongyear. com/d ri 11-rod-joi nt-depth-capacity-chart.
E. Anelli, et al., "Metallurgical Design of Advanced Heavy Wall Seamless pipes for Deepwater Applications", 4th International Conference on Pipeline Technology, May 9-13, 2004, Ostend, Belgium.
Echaniz, "The effect of microstructure on the KISSC of low alloy carbon steels", Nace Corrosion '98, EE. UU., Mar. 1998, pp. 22-27, San Diego.
Echaniz, G., Morales, C., Perez, T., "Advances in Corrosion Control and Materials in Oil and Gas Production" Papers from Eurocorr 97 and Eurocorr 98, 13, P. S. Jackman and L. M. Smith, Published for the European Federation of Corrosion, No. 26, European Federation of Corrosion Publications, 1999.
European Office Action in European Application No. 14159174.3 dated Sep. 16, 2016, 4 pages.
European Search Report in European Application No. 14159174.3, dated Jul. 10, 2014. 5 pages.
Extrait du Catalogue N 940, 1994.
Fang, Hong-Sheng, et al.: "The Developing Prospect of Air-cooled Bainitic Steels", International Journal of Issi, vol. 2, No. 2, Feb. 1, 2005, pp. 9-18.
Fratini et al.: "Improving friction stir welding of blanks of different thicknesses," Materials Science and Engineering A 459 (2007).
Fritz T et al, "Characterization of electroplated nickel", Microsystem Technologies, Dec. 31, 2002, vol. 9, No. 1-2, pp. 87-91, Berlin, DE.
Gojic, Mirko and Kosec, Ladislav, "The Susceptibility to the Hydrogen Embrittlement of Low Alloy Cr and CrMo Steels", ISIJ International, 1997, vol. 37, Issue 4, pp. 412-418.
Gomez, G. et al.: "Air cooled bainitic steels for strong, seamless pipes—Part 1—allowy design, kinetics and microstructure", Materials Science and Technology, vol. 25, No. 12.

(56) References Cited

OTHER PUBLICATIONS

Heckmann, et al., Development of low carbon Nb—Ti—B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", I IR, London, Apr. 1997, 11 pages.
Hutchings et al., "Ratio of Specimen thickness to charging area for reliable hydrogen permeation measurement," British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/SO, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Jacobs, Lucinda and Emerson, Steven, "Trace Metal Solubility in an Anoxid Fjord", Earth and Planetary Sci. Letters, Elsevier Scientific Publishing Company, 1982, vol. 60, pp. 237-252, Amsterdam, Netherlands.
Johnston, P.W., G.Brooks, "Effect of Al203 and TiO2 Additions on the Lubrication Characteristics of Mould Fluxes", Molten Slags, Fluxes and Salts 97 Conference, 1997 pp. 845-850.
Kazutoshi Ohashi et al, "Evaluation of r-value of steels using Vickers hardness test", Journal of Physics: Conference Series, Aug. 7, 2012, p. 12045, vol. 379, No. 1, Institute of Physics Publishing, Bristol, GB.
Keizer, Joel, "Statistical Thermodynamics of Nonequilibrium Processes", Springer-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mechanical Tubing and Cold Finishing, Metals Handbook Desk Edition, (2000), 5 pages.
Mehling, Wilfred L.: "Hot Upset Forging," ASM Handbook vol. 14, 1998, pp. 84-95.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Moessbauer Studies of Iron Sulfides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochimica et Cosmochimica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
NACE MR0175/ISO 15156-1 Petroleum and natural gas industries—Materials for use in H2S-containing Environments in oil and gas production—Part 1 : General principles for selection of crackina-resistant materials, Jun. 28, 2007.
Nagata, M., J. Speer, D. Matlock, "Titanium nitride precipitation behavior in thin slab cast high strength low alloyed steels", Metallurgical and Materials Transactions A, 2002 , vol. 33A, p. 30993110.
Nakai et al., "Development of Steels Resistant to Hydrogen Induced Cracking in Wet Hydrogen Sulfide Environment", Transactions of the ISIJ, 1979, vol. 19, pp. 401-410.
Nandan et al.: "Recent advances in friction-stir welding—Process, weldment structure and properties," Progress in Materials Science 53 (2008) 980-1023.
Pressure Equipment Directive 97/23/EC, May 29, 1997, downloaded from website: http://ec.europa.eu/enterprise/pressure equipment/ped/index en. html on Aug. 4, 2010.
Prevey, Paul, et al., "Introduction of Residual Stresses To Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Temperatures", Stockholm Contrib. Geo I., 1969, vol. 26, pp. 67-95.
Riecke, Ernst and Bohnenkamp, Konrad, "Uber den Einfluss von Gittersoerstellen in Eisen auf die X-abs Wassersroffdiffusion", Z. Metallkde, 1984, vol. 75, pp. 76-81 (Abstract).
Savatori et al. European Commission Report, EUR 2006, EUR2207, 3 pp. STN Abstract.
Shanabarger, M.R. and Moorhead, R. Dale, "H20 Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A Dasgupta, R. Bommaraju, "Characterization of the chemical interactions during casting of High-titanium low carbon enameling steels", 1991 Steelmaking Conference Proceeding, pp. 707-717.
Smyth, D., et al.: Steel Tubular Products, Properties and Selection: Irons, Steels, and High-Performance Alloys, vol. 1, ASM Handbook, ASM International, 1990, p. 327-336.
Specification for Threading, Gauging and Thread Inspection of Casing, Tubing, and Line Pipe Threads, American Petroleum Institute, Specification 58, Apr. 2008, 15th Edition (Excerpts Only).
Spry, Alan, "Metamorphic Textures", Perganon Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli et al., "Metakkurgical Aspects of Heavy Wall—High Strength Seamless Pipes for Deep Water Applications", RioPipeline, Oct. 17-19, 2005, Rio, Brasil.
Tivelli, M., G. Cumino, A Izquierdo, E. Anelli, A Di Schino, "Metallurgical Aspects of Heavy Wall—High Strength Seamless Pipes for Deep Water Applications", RioPipeline 2005, Oct. 17 to 19, 2005, Rio (Brasil), Paper n° IBP 1008 05.
Todoroki, T. Ishii, K. Mizuno, A Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstructure and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.

(56) References Cited

OTHER PUBLICATIONS

Wegst, C.W., "Stahlussel", Auflage 1989, Seite 119, 2 pages.
Yu, et al.: "New steels and alloys in mechanical engineering I ed.," M: Mechanical Engineering, 1976, p. 19.
"Seamless Steel Tubes for Pressure Purposes-Technical Delivery Conditions—Part 1: Non-alloy Steel Tubes with Specified Room Temperature Properties" British Standard BS EN 10216-1:2002 E:1-26, published May 2002.
"Seamless Steel Tubes for Pressure Purposes-Technical Delivery Conditions—Part 2: Non-alloy and Alloy Steel Tubes with Specified Elevated Temperature Properties" British Standard BS EN 102162:2002+A2:2007: E: 1-45, published Aug. 2007.
"Seamless Steel Tubes for Pressure Purposes—Technical Delivery Conditions—Part 3: Alloy Fine Grain Steel Tubes" British Standard BS EN 10216-3:2002 +A 1 :2004 E: 1-34, published Mar. 2004.
"Seamless Steel Tubes for Pressure Purposes—Technical Delivery Conditions—Part 4: Non-alloy and Alloy Steel Tubes with Specified Low Temperature Properties" British Standard BS EN 10216-4:2002 + A 1 :2004 E: 1-30, published Mar. 2004.
SDTX-4-17-CV-03299-222—Global Tubing—Order Granting Motion to Compel; Entered Mar. 26, 2021 USDC, SDTX; 30 pages.
SDTX-4-17-CV-03299-471 Global Tubing—Order Denying Motion to Compel; Entered Sep. 9, 2022; USDC, SDTX; 10 pages.

* cited by examiner

METHOD OF FORMING AND HEAT TREATING COILED TUBING

CROSS-REFERENCE TO RELATED APPLICATIONS

This application is a continuation of and claims the benefit of priority to U.S. patent application Ser. No. 14/872,490, filed Oct. 1, 2015, which is a divisional of U.S. patent application Ser. No. 13/229,517, now issued as U.S. Pat. No. 9,163,296 on Oct. 20, 2015, which claims the benefit of U.S. Provisional Application No. 61/436,156, filed Jan. 25, 2011, the entirety of each of which is hereby incorporated by reference.

BACKGROUND OF THE INVENTION

Field of the Invention

Embodiments of the present disclosure are directed toward coiled tubes and methods of heat treating coiled tubes. Embodiments also relate to coiled tubes with tailored or varied properties along the length of the coiled tube.

Description of the Related Art

A coiled tube is a continuous length of tube coiled onto a spool, which is later uncoiled while entering service such as within a wellbore. Coiled tubes may be made from a variety of steels such as stainless steel or carbon steel. Coiled tubes can, for example, have an outer diameter between about 1 inch and about 5 inches, a wall thickness between about 0.080 inches and about 0.300 inches, and lengths up to about 50,000 feet. For example, typical lengths are about 15,000 feet, but lengths can be between about 10,000 feet to about 40,000 feet.

Coiled tubes can be produced by joining flat metal strips to produce a continuous length of flat metal that can be fed into a forming and welding line (e.g., ERW, Laser or other) of a tube mill where the flat metal strips are welded along their lengths to produce a continuous length of tube that is coiled onto a spool after the pipe exits the welding line. In some cases, the strips of metal joined together have different thickness and the coiled tube produced under this condition is called "tapered coiled tube" and this continuous tube has varying internal diameter due to the varying wall thickness of the resulting tube.

Another alternative to produce coiled tubes includes continuous hot rolling of tubes of an outside diameter different than the final outside diameter (e.g., U.S. Pat. No. 6,527,056 B2 describes a method producing coiled tubing strings in which the outer diameter varies continuously or nearly continuously over a portion of the string's length, WO2006/078768 describes a method in which the tubing exiting the tube mill is introduced into a forging process that substantially reduces the deliberately oversized outer diameter of the coil tubing in process to the nominal or target outer diameter, and EP 0788850 describes an example of a steel pipe-reducing apparatus, the entirety of each of which is hereby incorporated by reference, describe such tubes).

These methods described above produce coiled tube having constant properties since the tube is produced with the same material moving continuously through the same process. Therefore, the final design of the produced tube (e.g., dimension and properties) is a compromise between all the tube requirements while in service.

SUMMARY

Described herein are coiled tubes with improved and varying properties along the length. In some embodiments, the coiled tubes may be produced by using a continuous and dynamic heat treatment process (CDHT). The resulting new product is a "composite" tube in the sense that the properties are not constant, generating a composite coiled tube (e.g., a continuous length of tube that can be coiled onto a spool for transport and uncoiled for use) with unique and optimized properties. The production of a continuous length of composite coil tube may be performed by introducing a previously produced spool of such product into a continuous and dynamic heat treatment line in order to generate a new material microstructure. The heat treatment is continuous because the tube moves through subsequent heating and cooling processes and it is dynamic because it can be modified to give a constantly changing heat treatment to different sections of the coiled tube.

Continuous coil tube may be made from shorter lengths of flat metal strip which are joined end-to-end, formed into tubular form, and seam welded to produce the starting coiled tube for the process are described herein. The starting coiled tube is thereafter introduced into a CDHT process. The CDHT modifies the microstructure thereby improving properties and minimizing heterogeneous properties between the tube body, the longitudinal weld, and the welds made to join the flat metal strips.

The heat treatment variables can be modified continuously in order to generate different mechanical properties, corrosion resistance properties, and/or microstructures along the length of the coiled tube. The resulting composite coiled tube could have localized increase in properties or selected properties in order to allow working at greater depths, localized increased stiffness to minimize buckling, increased corrosion resistance locally in the areas where exposure to higher concentrations of corrosive environments is expected, or any tailored design that has variation of properties in a specific location.

This variation of properties can result in a minimization or reduction of tapers, improving fatigue life, keeping the internal diameter constant for longer distances, minimizing unnecessary strip-to-strip welds, decreasing weight, improving inspection capabilities, tube volume and capacity among others. In particular, weight can be reduced by having an average wall thickness of the tube less than a tube with tapers since a tapered tube has increased wall thickness in certain regions such as the sections of tube at the top of a well. The outer diameter (OD) of the tapered tube typically remains constant while the inner diameter (ID) of the tube is changed to change the wall thickness. For example, an increase in wall thickness of a section of tube can decrease the ID of the section of tube. Therefore, a tube without tapering can have an ID that is substantially the same throughout the tube. By having a substantially constant ID, the ID along the entire length of tube can be inspected. For example, to inspect the ID, a drift ball can be used. However, the drift ball can only be used to inspect the smallest ID of the tapered tube. In addition, fluid flow rate through a tapered tube (e.g., capacity) is limited to the smallest ID of the tube. Therefore, by not reducing ID in certain sections of the tube by increasing wall thickness, the volume and capacity of the tube can be increased.

In certain embodiments, a method of treating a tube is provided. The method can include providing a spool of the tube, uncoiling the tube from the spool, heat treating the uncoiled tube to provide varied properties along a length of the uncoiled tube, and coiling the tube after heat treating. The varied properties may include mechanical properties. At least one of temperature, soak time, heating rate, and cooling rate can be varied during heat treating of the uncoiled tube to provide varied properties along the length of the uncoiled tube. In certain embodiments, the tube is heat treated with two or more heat treatments (e.g., a double quench and tempering process). The tube may have a substantially constant wall thickness throughout the tube. The tube may have fewer changes in wall thickness as a result of the varied properties along the length of the tube in comparison to conventional tube without the varied properties to maintain sufficient properties for a particular application.

In certain embodiments, a coiled tube is provided. The coiled tube includes a first substantial portion of the tube having a first set of properties and a second substantial portion of the tube having a second set of properties such that at least one property of the first set of properties is different from at least one property of the second set of properties. For example, the difference between at least one property of the first set of properties and at least one property of the second set of properties can be larger than general variations in at least one property as a result of substantially similar steel composition with substantially similar heat treatment processing. At least one property of the first and second set of properties may include yield strength, tensile strength, fatigue life, corrosion resistance, grain size, or hardness. For example, the first substantial portion of the tube can include a first yield strength and the second substantial portion of the tube can include a second yield strength different (e.g., less or greater) than the first yield strength.

The tube may have fewer changes in wall thickness as a result of the varied properties along the length of the tube in comparison to conventional tube without the varied properties to maintain sufficient properties for a particular application. The tube may have a substantially constant wall thickness throughout the tube. Furthermore, the tube can have a substantially uniform composition throughout the tube. The tube may include a plurality of tube sections welded together and at least a portion of one of the tube sections of the plurality of tube sections comprises the first substantial portion and at least another portion of the same tube section comprises the second substantial portion.

In certain embodiments, a coiled tube for use in a well is provided. The coiled tube can include a continuous length of tube comprising a steel material having a substantially uniform composition along the entire length of the tube. The tube has at least a first portion configured to be positioned at the top of the well and at least a second portion configured to be positioned toward the bottom of the well relative to the first portion. The first portion of tube has a first yield strength and the second portion of tube has a second yield strength, the first yield strength can be different (e.g., greater or less) than the second yield strength. In some embodiments, the first portion has a yield strength greater than 100 ksi or about 100 ksi and the second portion has a yield strength less than 90 ksi or about 90 ksi. In further embodiments, the tube further includes a third portion of tube having a third yield strength between that of the first and second yield strength, the third portion being located between the first and second portions. However, the CDHT allows for the production of numerous combinations of properties (e.g. YS) for any length of pipe.

The tube can have a length of between 10,000 feet and 40,000 feet (or between about 10,000 feet and about 40,000 feet). The first portion of tube may have a length of between 1,000 feet (or about 1,000 feet) and 4,000 feet (or about 4,000 feet). Furthermore, the tube may include a plurality of tube sections welded together, and each of the tube sections may have a length of at least 1,500 feet (or about 1,500 feet). The length of each tube section is related to the distance between bias welds to form the tube. The tube sections may be welded together after being formed into tubes or may be welded together as flat strips which are then formed into the tube. The tube may have a substantially constant wall thickness. For example, the first portion includes a first wall thickness and the second portion includes a second wall thickness that can be substantially the same as the first wall thickness. The first portion includes a first inner diameter and the second portion includes a second inner diameter that can be substantially the same as the first inner diameter.

In some embodiments, the tube has an outer diameter between 1 inch and 5 inches (or between about 1 inch and about 5 inches). The tube may have a wall thickness between 0.080 inches and 0.300 inches (or between about 0.080 inches and about 0.300 inches). In further embodiments, the tube has a substantially constant wall thickness along the entire length of the tube. The tube may have a substantially constant inner diameter along the entire length of the tube. The tube may have no taperings in some embodiments, while in other embodiments, the tube has at least one taper.

DETAILED DESCRIPTION

Described herein are coiled tubes having varying properties along the length of the coiled tube and methods of producing the same. In certain embodiments, a continuous and dynamic heat treatment process (CDHT) can be used to produce coiled tube with varying properties along the length of the coiled tube. The heat treatment is continuous because the tube moves through subsequent heating and cooling processes, and the heat treatment is dynamic because it can be modified to give a constantly changing heat treatment to different sections of the coiled tube.

The heat treatment variables can be modified continuously in order to generate different mechanical properties along the length of the coiled tube. The resulting composite coiled tube can have at least a first portion of the tube having a first set of properties and a second portion of the tube having a second set of properties such that at least one property of the first set of properties is different from at least one property of the second set of properties.

In many applications, the coiled tube will be hanging inside a well and the coiled tube should be strong enough to support the associated axial loads; in other applications, the coiled tube will be pushed inside a well and when removed, the coiled tube will be pulled against the friction forces inside the well. In these examples, the material of the coiled tube on the top of the well will be subjected to the maximum axial load. In addition, for a deeper well, the wall thickness on the upper part of the coiled tube may be increased in order to withstand the axial load (both from hanging or pulling). The use of tapered tubes has been used to allow increasing wall thickness only in the upper part of the coiled tube in order to reduce the total weight of the coiled tube. Materials of different compositions with higher mechanical properties have also been used in order to increase the resistance of the axial load, but these materials tend to be more expensive, more difficult to process, and have lower corrosion resistance.

In other applications, the coiled tube is pushed inside the well and there may be a requirement for increased stiffness; then the specification for the tube may require increased mechanical properties in order to maximize the stiffness of the coiled tube. In other cases, some areas of the well experience different temperatures and corrosive environments, and the coiled tube is specified with resistance to corrosive environments. Increased corrosion resistance can be produced by decreasing other material properties such as mechanical properties, which is contrary to the objective of increase axial resistance and stiffness.

Figure 1:
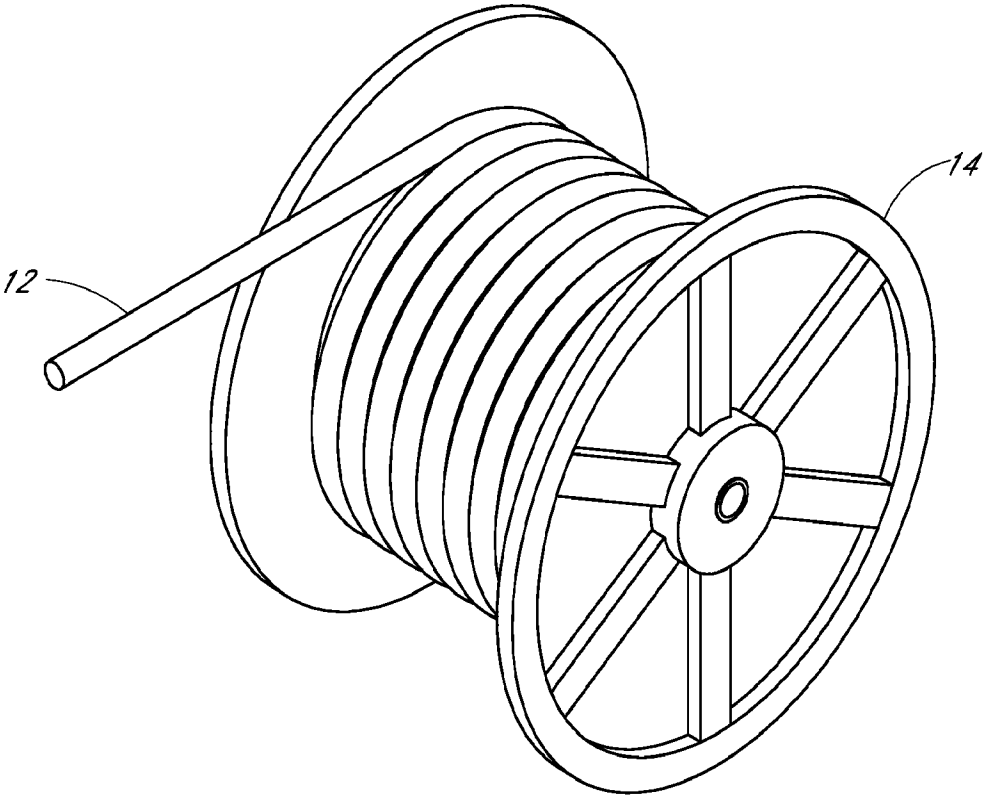
FIG. 1 illustrates an example coiled tube on a spool.
Figure 2:
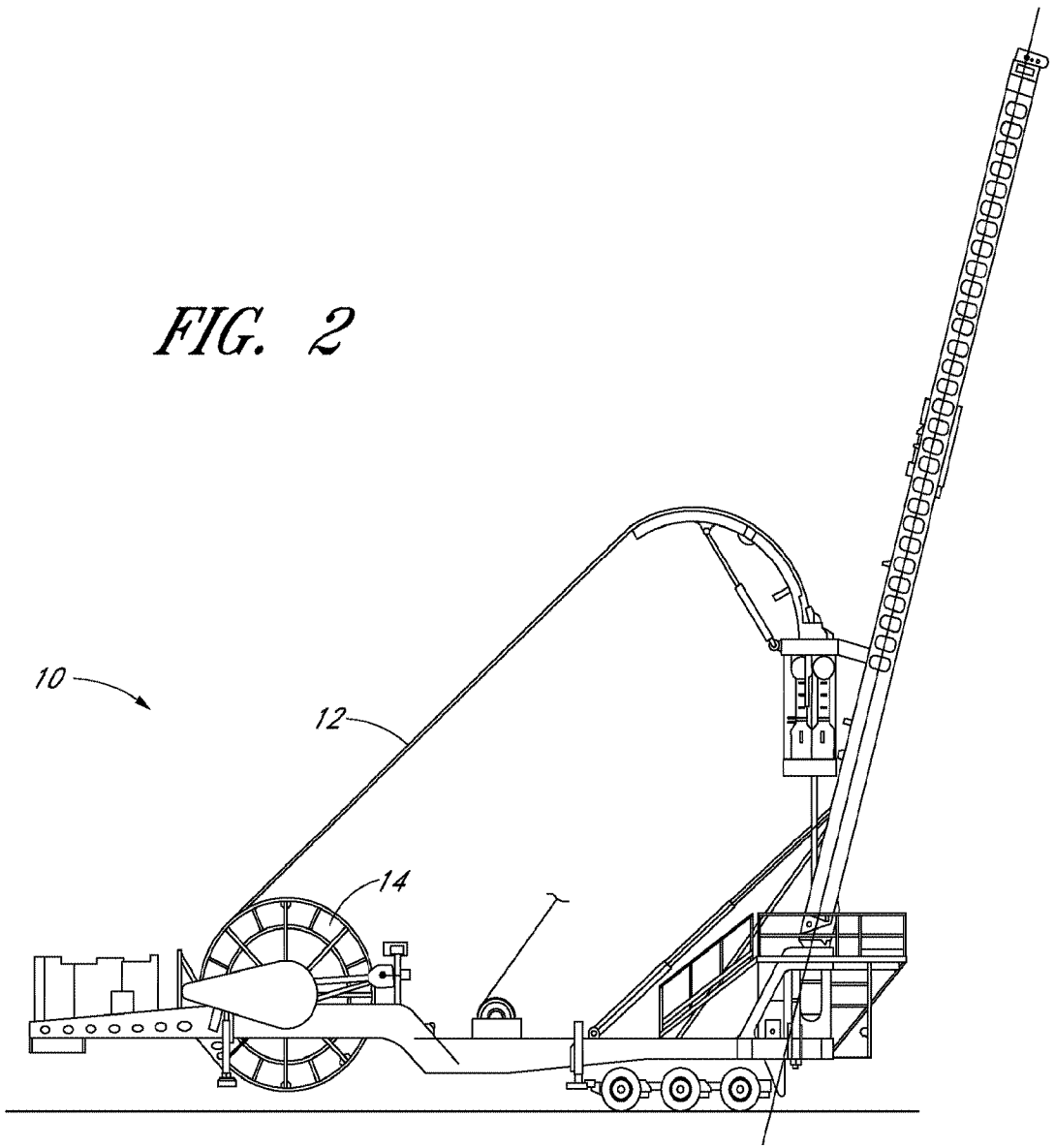
FIG. 2 illustrates an example rig configured to coil and uncoil tube from a spool.

Coiled tube is used by service companies that will provide a service in one location and then remove the coiled tube, recoil it and move it to a different location. FIG. 1 illustrates an example coiled tube 12 on a spool 14, and FIG. 2 illustrates an example rig 10 that can coil and un-coil coiled tube 12 on a spool 14 and direct the tube 12 into a well. The performance and fatigue life of the tube is related to low cycle fatigue associated with the coiling and un-coiling of the tube in each service operation. The fatigue life is usually reduced in the areas where the flat metal was originally joined. Also, the fatigue life is affected by the mechanical properties and operative conditions of the welding process.

Described herein is a product in which, by a special process, the coiled tube can be produced as a "composite" tube, in which the best properties for each section of the coiled tube are targeted. In this way, the tube properties are tailored along the length of the tube to generate the desired properties in the right place resulting in an overall increase of life due to fatigue, increase in corrosion resistance, and minimization of weight.

The special process (e.g., CDHT) takes advantage of the fact that material properties can be varied with appropriate heat treatments. Since a heat treatment is basically combinations of temperature and time, in a continuous heat treatment process, the temperature and speed (including heating and cooling rates) could be dynamically varied in order to modify the final properties of virtually every section of the tube being treated. Another advantage of the process is that since the final properties are affected by the final temperature and time cycle, the properties of the coiled tube could be fixed (e.g., repaired) if there has been a problem during the process, the heat treatment could be used to refurbish already used coiled tube if severe but reversible damage had occurred, or the heat treatment could be used to change properties of already produced coiled tube. This type of treatment allows the service companies to specify the best coiled tube for a given operation regardless of the number of wells the coiled tube is planned to operate in. If the tailored coiled tube does not find more wells to service and it is obsolete (e.g., the coiled tube does not have properties for available applications), its properties could be changed provided there is no irreversible damage to the coiled tube. In this way, the process (e.g., CDHT) described herein can generate a unique product (e.g., coiled tube) that could act as new product, new process for operation, and a new service. For example, the unique product can open up the possibility for a new "service" for repairing old coiled tubes or changing properties.

Figure 3:
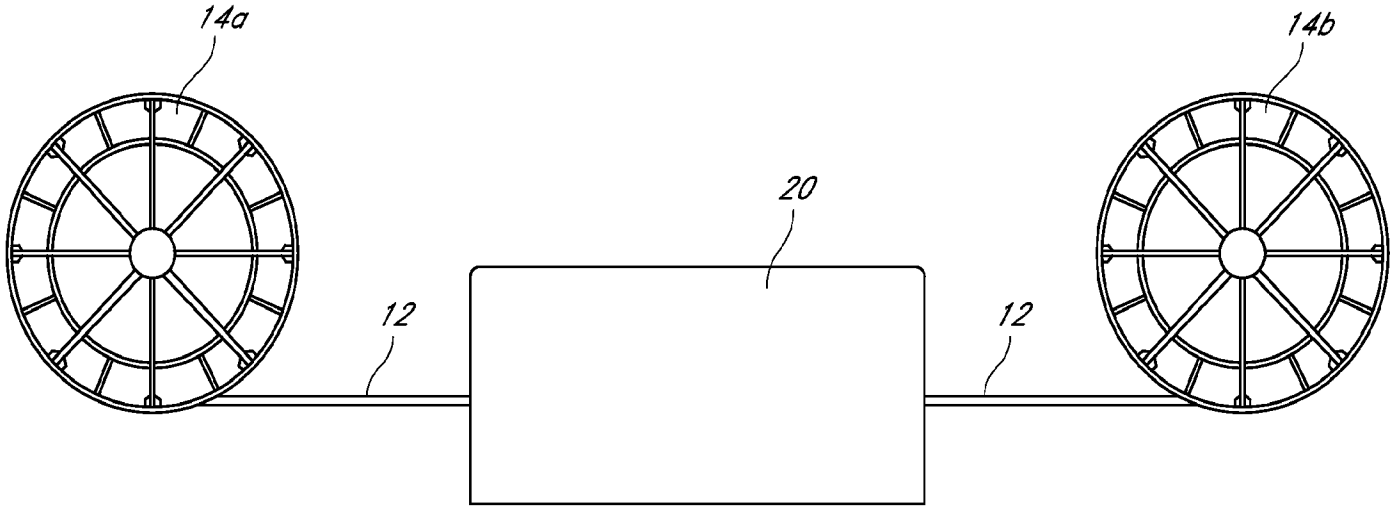
FIG. 3 illustrates an example of a continuous and dynamic heat treatment process.

In certain embodiments, a method of treating a tube includes providing a spool of the tube, uncoiling the tube from the spool, heat treating the uncoiled tube to provide varied properties along a length of the uncoiled tube, and coiling the tube after heat treating. FIG. 3 is a schematic that illustrates one embodiment. Tube 12 is uncoiled from a first spool 14*a*. After being uncoiled, the tube 12 goes through a CDHT process represented by box 20 and is then re-coiled on a second spool 14*b*.

In certain embodiments, the varied properties include mechanical properties. For example, the mechanical properties can include yield strength, ultimate tensile strength, elastic modulus, toughness, fracture toughness, hardness, grain size, fatigue life, fatigue strength. Many mechanical properties are related to one another such as fracture toughness, hardness, fatigue life, and fatigue strength are related to tensile properties.

The varied properties may include corrosion resistance. Corrosion resistance can include sulfide stress cracking (SSC) resistance. Hydrogen sulfide ($H_2S$) dissolves in fluid (e.g., $H_2O$), and the corrosive environment can be measured by pH and the amount of $H_2S$ in solution. Generally, the higher the pressure, the more $H_2S$ can be in solution. Temperature may also have an effect. Therefore, deeper locations in the well experience higher pressure and higher $H_2S$ concentrations. As such, corrosion resistance of the tube can be increased along the length of the tube toward the section of tube at the bottom of the well. For example, about the bottom 75% of the well generally has the worst corrosive environment. Therefore, in certain embodiments, the bottom 75% of the length of tube has lower mechanical properties and hence higher corrosion resistance properties than the top 25% of the length of tube.

In general, corrosion resistance is related to mechanical properties. For example, international standard NACE MR0175/ISO 155156 "Petroleum and natural gas industries—Materials for use in $H_2S$-containing environments in oil and gas production" in Appendix A (A.2.2.3 for Casing and Tubing), the entirety of which is hereby incorporated by reference, shows a direct correlation of corrosion resistance to mechanical properties. In particular, Appendix A lists some materials that have given acceptable performance for resistance to SSC in the presence of $H_2S$, under the stated metallurgical, environmental and mechanical conditions based on field experience and/or laboratory testing. Appendix A indicates that as severity of the environment increases from region 1 to region 3 (increase $H_2S$ partial pressure and/or pH decreases), the recommendation for maximum yield strength (YS) decreases. For example, for region 1 of low severity YS<130 ksi (HRC<30), for region 2 of medium severity YS<110 ksi (HRC<27) and for region 3 of high severity (HRC<26 or maximum API5CT grade is T95 with HRC<25.4), suitable recommended material in all regions can be Cr—Mo quench and tempered steels.

Table I compares a standard steel product used for a coiled tube that has a ferrite and pearlite microstructure and varying grain size with steel that is quench and tempered.

Corrosion resistance of the quench and tempered steel is better than the standard product due to the uniformity of microstructure. Corrosion resistance of 80 ksi to 110 ksi coiled tube decreases as indicated, for example, in ISO 15156.

TABLE I

| | | Grade 80 (YS ≈ 85 ksi) | Grade 90 (YS ≈ 95 ksi) | Grade 110 (YS ≈ 115 ksi) | Corrosion Resistance (due to microstructure) |
|---|---|---|---|---|---|
| Product Type | Standard Product | Ferrite + Pearlite + Bainite Grain Size (GS) 80 > GS 90 > GS 110 | | | Low (non-uniform microstructure) |
| | Quench and Tempered | Tempered Martensite Carbide Size (CS) 80 > CS 90 > CS 110 Dislocation Density 80 < 90 < 110 | | | High (uniform microstructure) |
| Corrosion Resistance (due to YS) | | High | Medium | Low | |

During heat treatment, the microstructure will change from ferrite and pearlite to tempered martensite in the case of a quench and tempered process. A microstructure from a quench and tempered process is recommended by NACE for high strength pipes with SSC resistance. Also, carbide refinement due to tempering increases toughness. Localized hardness variations are reduced due to the elimination of pearlite or even bainite colonies that can result from segregation in as-rolled material. Localized increased hardness is detrimental for corrosion resistance. Fatigue life can also be increased by reduction of welds between sections of the tube, improving microstructure of the weld area through heat treatment, and/or reduction of mechanical properties.

A variety of steel compositions can be used in the methods described herein. Furthermore, various steel compositions can be used in the quench and temper process. Steel compositions can include, for example, carbon-manganese, chromium, molybdenum, boron and titanium, or a combination thereof. The steel composition may be selected based on, for example, the line speed, water temperature and pressure, product thickness, among others. Example steel compositions include:

Chromium bearing steel: the coiled tube comprising 0.23 to 0.28 wt. % (or about 0.23 to about 0.28 wt. %) carbon, 1.20 to 1.60 wt. % (or about 1.20 to about 1.60 wt. %) manganese, 0.15 to 0.35 wt. % (or about 0.15 to about 0.35 wt. %) silicon, 0.015 to 0.070 wt. % (or about 0.015 to about 0.070 wt. %) aluminum, less than 0.020 wt. % (or about 0.020 wt. %) phosphorus, less than 0.005 wt. % (or about 0.005 wt.) % sulfur, and 0.15 to 0.35 wt. % (about 0.15 to about 0.35 wt. %) chromium;

Carbon-Manganese: the coiled tube comprising 0.25 to 0.29 wt. % (or about 0.25 to about 0.29 wt. %) carbon, 1.30 to 1.45 wt. % (or about 1.30 to about 1.45 wt. %) manganese, 0.15 to 0.35 wt. % (or about 0.15 to about 0.35 wt. %) silicon, 0.015 to 0.050 wt. % (or about 0.015 to about 0.050 wt. %) aluminum, less than 0.020 wt. % (or about 0.020 wt. %) phosphorus, and less than 0.005 wt. % (or about 0.005 wt. % sulfur);

Boron-Titanium: the coiled tube comprising 0.23 to 0.27 wt. % (or about 0.23 to about 0.27 wt. %) carbon, 1.30 to 1.50 wt. % (or about 1.30 to about 1.50 wt. %) manganese, 0.15 to 0.35 wt. % (or about 0.15 to about 0.35 wt. %) silicon, 0.015 to 0.070 wt. % (or about 0.015 to about 0.070 wt. %) aluminum, less than 0.020 wt. % (or about 0.020 wt. %) phosphorus, less than 0.005 wt. % (or about 0.005 wt. %) sulfur, 0.010 to 0.025 wt. % (or about 0.010 to about 0.025 wt. %) titanium, 0.0010 to 0.0025 wt. % (or about 0.0010 to about 0.0025 wt. %) boron, less than 0.0080 wt. % (or about 0.0080 wt. %) N and a ratio of Ti to N greater than 3.4 (or about 3.4); and Martensitic Stainless Steel: the coiled tube comprising 0.12 wt. % (or about 0.12 wt. %) carbon, 0.19 wt. % (or about 0.19 wt. %) manganese, 0.24 wt. % (or about 0.24 wt. %) Si, 11.9 wt. % (or about 11.9 wt. %) chromium, 0.15 wt. % (or about 0.15 wt. %) columbium, 0.027 wt. % (or about 0.027 wt. %) molybdenum, less than 0.020 wt. % (or about 0.020 wt. %) phosphorus, and less than 0.005 wt. % (or about 0.005 wt. %) sulfur.

Molybdenum could be added to the steel compositions above, and some steel compositions can be combined B—Ti—Cr to improve hardenability. Described in Example 1 in the below examples is a chromium bearing steel.

In certain embodiments, at least one of temperature, soak time, heating rate, and cooling rate is varied during heat treating of the uncoiled tube to provide varied properties along the length of the uncoiled tube.

In certain embodiments, the tube has fewer changes in wall thickness as a result of the varied properties along the length of the tube in comparison to conventional tube without the varied properties in order to maintain sufficient properties for a particular application. The tube may even have a substantially constant wall thickness throughout the tube (e.g., the tube has no tapers). The flat metal strips that are used to form tube sections of the tube can be, for example, between 1,500 feet and 3,000 feet (or about 1,500 feet and about 3,000 feet). Flat metal strips with smaller thickness may be longer than flat metal strips with larger thickness. However, if additional changes in wall thicknesses are desired, the flat metal strips may be shorter to allow for additional changes in wall thickness. Thus, if the length of the flat metal strip needed for each change in wall thickness is shorter than the possible maximum length of the flat metal strip, an extra weld joint is required. As previously discussed, additional weld joints can decrease fatigue life. Therefore, as described herein, the number of weld joints can be decreased by minimizing the number of changes in wall thickness. For example, each tube section can have a length that is maximized. In certain embodiments, the tube does not have a tube section that is less than 1,500 feet long. In further embodiments, the average length of the tube sections is greater than 2,500 feet along the entire length of the tube. In further embodiments, the average length of tube sections is greater than if there were taper changes in the tube.

In certain embodiments, the starting coiled tube is unspooled at one end of the process, then it moves continuously through the heat treatment process and is spooled again on the other end. The spooling devices can be designed to allow rapid changes in spooling velocity, and they can be moved to follow the coiled tube in order to change the spooling or un-spooling velocity in longitudinal units of tube per unit time even more rapidly (flying spooling).

Figure 4:
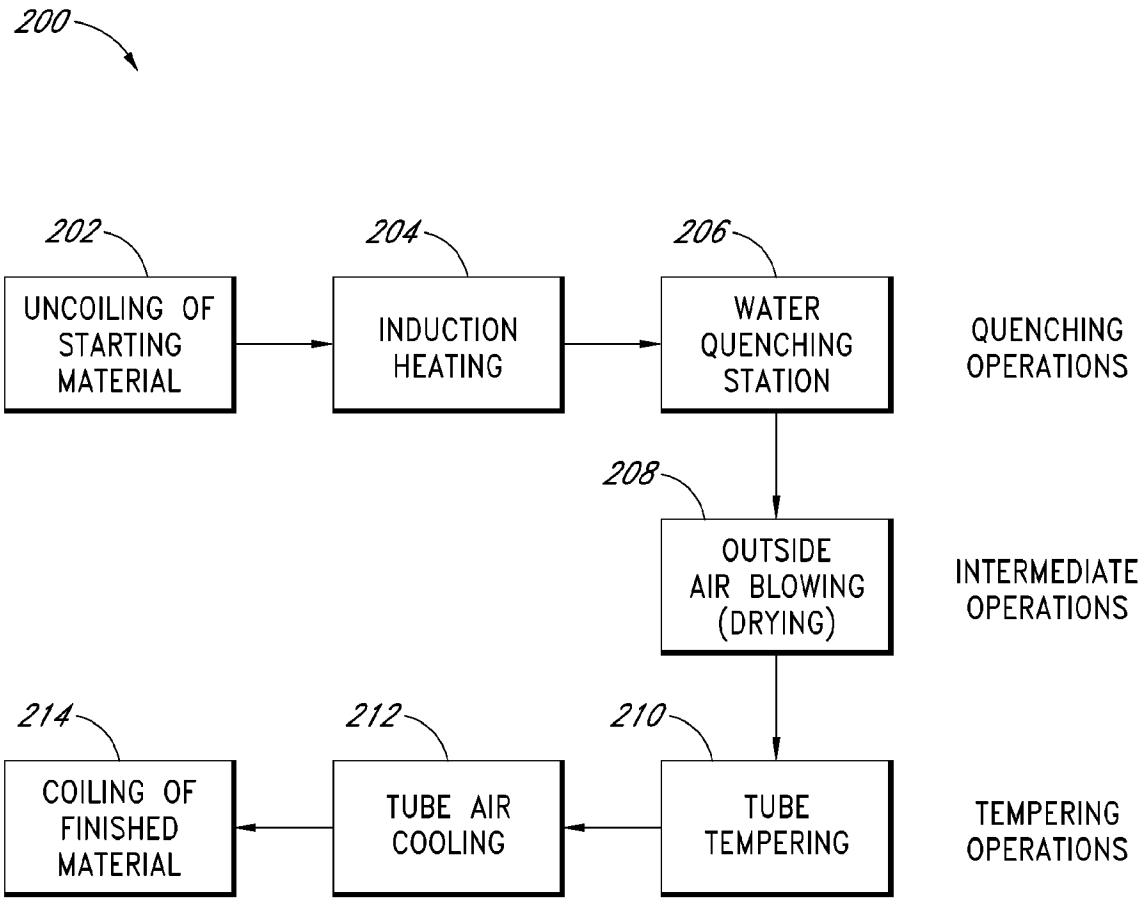
FIG. 4 is a flow diagram of an embodiment of a method of using a continuous and dynamic heat treatment process.

The CDHT itself can include a series of heating and cooling devices that can easily change the heating and cooling rate of the material. In one example, the material is quenched and tempered dynamically, and FIG. 4 is an example flow diagram of the method 200. The method 200 can include quenching operations, intermediate operations, and tempering operations. In operational block 202, a coiled tube of a starting material is uncoiled. In operational block 204, the tube moves through a heating unit and then, in operational block 206, is quenched with water from the outside. The heating unit can modify the power in order to compensate for the changing mass flow when the tube's outer diameter and wall thickness changes, keeping productivity constant. It can also modify the power if the linear speed is changed when the tempering cycle is adjusted, keeping quenching temperatures constant but final properties different. In operational block 208, the tube can be dried.

The tempering operation can include a heating unit and a soaking unit. For example, in operational block 210, the tube can be tempered, and in operational block 212 the tube can be cooled. The stands of the soaking unit could be opened and ventilated so they can rapidly change the total length (e.g., time) of soaking, and at the same time, they can rapidly change the soaking temperature. At the exit of the soaking line, different air cooling devices can be placed in order to cool the tube to a coiling temperature at which there will not be further metallurgical changes. The control of the temperature and speed allows estimating the exact properties of the complete coiled tube, which is an advantage over certain conventional coiled tubes where testing is performed and properties can be only measured in the end of the spools. In certain conventional coiled tubes, the mechanical properties are estimated from less precise models for hot rolling at the hot rolled coil supplier as well as cold forming process during electrical resistive welding (ERW) forming. In operational block 214, the tube can be coiled onto a spool.

The resulting coiled tube can have a variety of configurations. In certain embodiments, a coiled tube includes a first substantial portion of the tube having a first set of properties, and a second substantial portion of the tube having a second set of properties such that at least one property of the first set of properties is different from at least one property of the second set of properties. Furthermore, the coiled tube may have more than two substantial portions. For example, the coiled tube may have a third substantial portion of tube which have a third set of properties such that at least one property of the third set is different from at least one property of the first set of properties and at least one property of the second set of properties. A substantial portion described herein may be a portion with a sufficient size (e.g., length) to enable measurement of at least one property of the portion. In certain embodiments, at least one property of the coiled tube varies continuously (e.g., near infinite number of portions).

In some embodiments, the first substantial portion of the tube has a first length between 1000 feet and 4000 feet (or between about 1,000 feet and about 4,000 feet), and the second substantial portion of the tube has a second length of at least 4000 feet (or at least about 4,000 feet). The first and second substantial portions may also have other various lengths.

In certain embodiments, at least one property of the first and second set of properties including yield strength, ultimate tensile strength, fatigue life, fatigue strength, grain size, corrosion resistance, elastic modulus, hardness, or any other properties described herein. Furthermore, a change of mechanical properties (e.g., yield strength) could allow a change in weight of the coiled tube.

In certain embodiments, the tube has fewer changes in wall thickness as a result in the varied properties along the length of the tube in comparison to conventional tube without the varied properties in order to maintain sufficient properties for a particular application. The tube may even have a substantially constant wall thickness throughout the tube.

In certain embodiments, the tube has a substantially uniform composition throughout the tube. For example, the tube may have tube segments that were welded together that do not have significant differences in composition (e.g. tube segments with substantially similar composition). Tube segments can include either (1) tube segments that appear welded together since they were made by welding flat strips, formed into a tube, and welded longitudinally or (2) tube segments that are welded together after being formed into tubes and longitudinally welded.

EXAMPLES

The following examples are provided to demonstrate the benefits of the embodiments of the disclosed CDHT and resulting coiled tube. For example, as discussed below, coiled tube may be heat treated to provide coiled tube with overall unique properties. These examples are discussed for illustrative purposes and should not be construed to limit the scope of the disclosed embodiments.

Example 1

As an example, a steel design that is quenched and tempered could include sufficient carbon, manganese and could include chromium or molybdenum or combinations of boron and titanium, and be quenched and tempered at different temperatures. Various other steel compositions such as those described above can also be quenched and tempered in similar methods. In the example below, the coiled tube is comprised of about 0.23 to about 0.28 wt. % carbon, about 1.20 to about 1.60 wt. % manganese, about 0.15 to about 0.35 wt. % silicon, about 0.015 to about 0.070 wt. % aluminum, less than about 0.020 wt. % phosphorus, less than about 0.005 wt. % sulfur, and about 0.15 to about 0.35 wt % chromium. The amount of each element is provided based upon the total weight of the steel composition.

Figure 5:
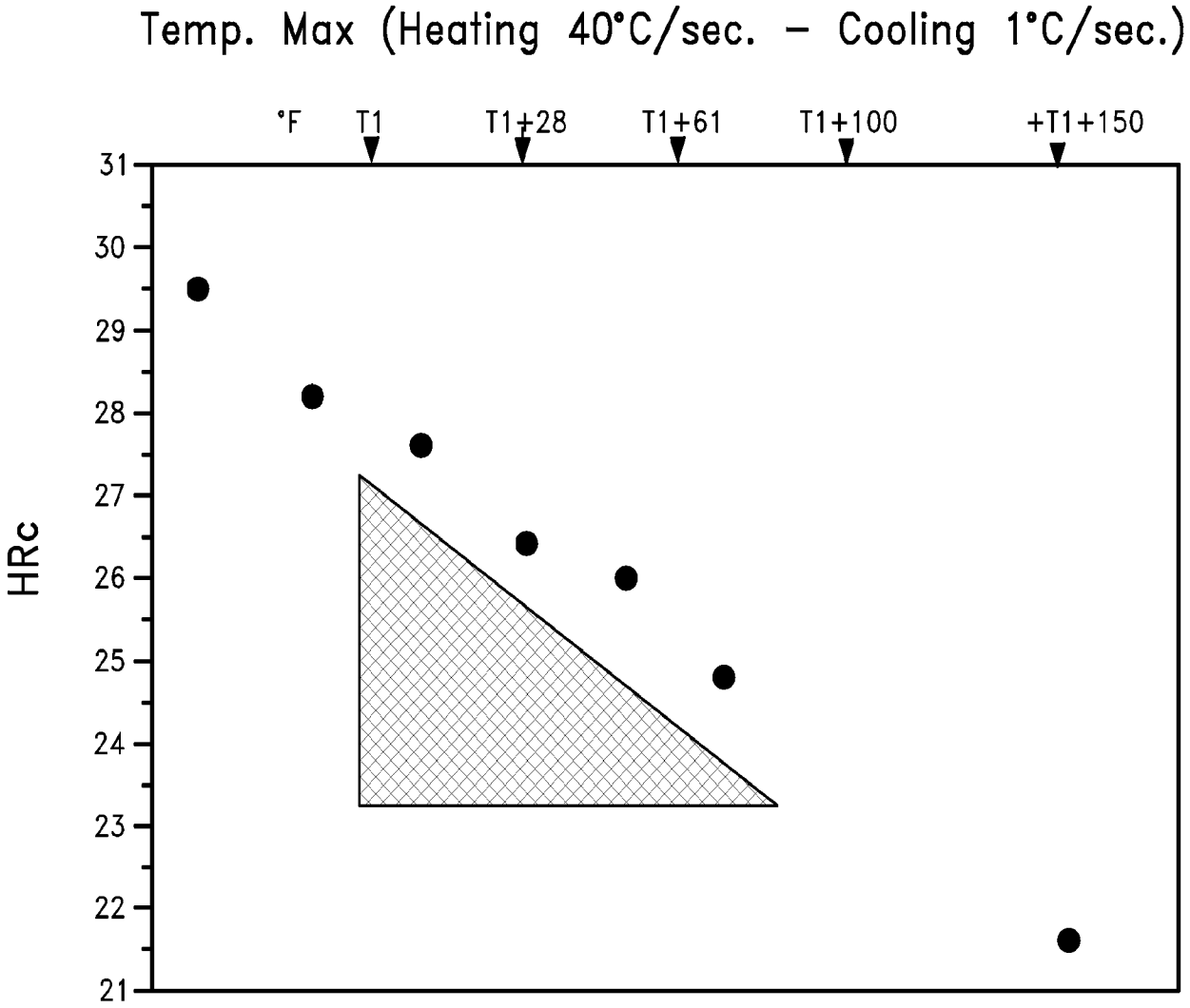
FIG. 5 is a plot of Rockwell C hardness (HRC) as a function of maximum temperature for tempering cycles which include heating and cooling at 40° C./sec and 1° C./sec, respectively.

Laboratory simulations and industrial trials were used to measure the material response to quench and tempering cycles. The lengths were selected to guarantee uniform temperatures (more than 40 feet per condition, the material moved continuously through heating and cooling units in the industrial test and was stationary in the lab simulations). The material was subjected to tempering cycles of different maximum temperatures by heating by induction at 40° C./sec up to the maximum temperature and then cooling in air at 1° C./sec (see FIG. 5 which shows the variation of hardness measured in Rockwell C scale (HRC) of the material as a function of maximum temperature). T1 in FIG. 5 is a reference temperature (about 1050° F. in this example) that results in a hardness of about 27.5 HRC. The reference temperature and resulting hardness can vary depending on steel composition. These particular cycles did not have a soaking time at the maximum temperature (e.g. the material was not held at the maximum temperature for any significant time), but equivalent cycles at lower temperatures and for longer time could be applied. The material was previously water quenched to the same starting hardness level and to a microstructure composed of mainly martensite (more than 80% in volume).

By applying these tempering cycles, the final properties (e.g. yield strength) could be controlled from 80 to 140 ksi allowing the production of different final products. As indicated by the slope of the hardness as a function of temperature graph in FIG. 5, four points of hardness variation (approximately 11 ksi variation in tensile strength) can be produced if the maximum temperature is varied by more than 70° C. (e.g., hatched triangle in FIG. 5). The tensile strength is related to hardness, and discussion of the relationship can be found, for example, in Materials Science and Metallurgy, by H. Pollack, $4^{th}$ edition, 1988, Prentice Hall, page 96, Table 3; shows that a 22.8 HRC is equivalent to 118 ksi and 26.6 HRC is equivalent to 129 ksi. A hardness difference of 3.8 HRC is 11 ksi in tensile strength. Certain other quench and tempered steels have also been observed to have a similar relationship. This temperature variation is much larger than the control capability of the tempering furnaces, and this example indicates that the tensile strength could be controlled at any point of the tube to much less than a 11 ksi variation. In a standard product without heat treatment, the mechanical properties variation along the length of a hot-rolled coil can be 11 ksi and between coils up to 15 ksi, so the mechanical properties of a standard product may vary along the length of the tube but in an uncontrolled way. In addition, in the standard product, these properties may vary as the tube is formed to different diameters; while in the case of the CDHT tubes these properties can remain constant with chemistry.

As demonstrated, the composite tube produced by a dynamic control of heat treatment process can have precisely selected properties that vary in a controlled fashion in each section of the tube. Calibration curves for the material used in this process allows controlling the exact properties at each location of the tubes by recording the temperature. Similar experiments on other compositions of tube can be used to create calibration curves which can then be used to create process parameters of the CDHT process to produce a coiled tube with select properties along the length of the tube. In addition, tempering models can be used to select processing conditions that could yield select properties along the length of the tube by varying parameters such as time and temperature. For example, Hollomon et al., "Time-temperature Relations in Tempering Steel," Transactions of the American Institute of Mining, 1945, pages 223-249, describes a classical tempering model approach. Hollomon describes that the final hardness after tempering of a well quenched material (high % of martensite) is a function of a time-temperature equation that varies with the type of steel. This model can be used to calculate the final hardness of a material after tempering for any combination of time and temperatures after generating some experimental data. The calibration curves for a tempering process can be generated after the model has been fitted with the experimental data.

In order to dynamically change the properties, the temperature can be increased rapidly or decreased rapidly using induction heating, air cooling or changing the soaking time (if the cycle of tempering uses temperature and a soaking time and not only temperature as is the case for the example in FIG. 5). This process can be used to generate a unique coiled tube product with varying properties that are changed in order to optimize its use as shown in the examples below. The heat treated microstructure can be much more refined and homogeneous than the hot-rolled microstructure, which can provide improved corrosion and fatigue performance. The heat treatment can also relieve internal stresses of the material, which were generated during forming (e.g., hot-rolling and pipe forming).

Example 2

In certain applications, a coiled tube may be required to operate in wells of up to 22,500 ft deep. The tube minimum wall thickness may be 0.134" and the tube OD may be 2.00". The material may also have good performance in $H_2S$ containing environments and good fatigue life.

If the tube is designed for axial load, without taper changes and with a safety factor of 70%, the material may have a Specified Minimum Yield Strength (SMYS) of at least 110 ksi:

$$0.70\times\text{SMYS}=A(\text{area})\times L(\text{length})\times\text{Density}/A=L\times\text{Density}$$

$$\text{SMYS}=L\times\text{Density}/0.70=22{,}500\ \text{ft}\times(0.283\ \text{lb/in}^3)\times(12\ \text{in/ft})/0.70$$

$$\text{SMYS}\approx 110{,}000\ \text{psi}$$

Figure 6:
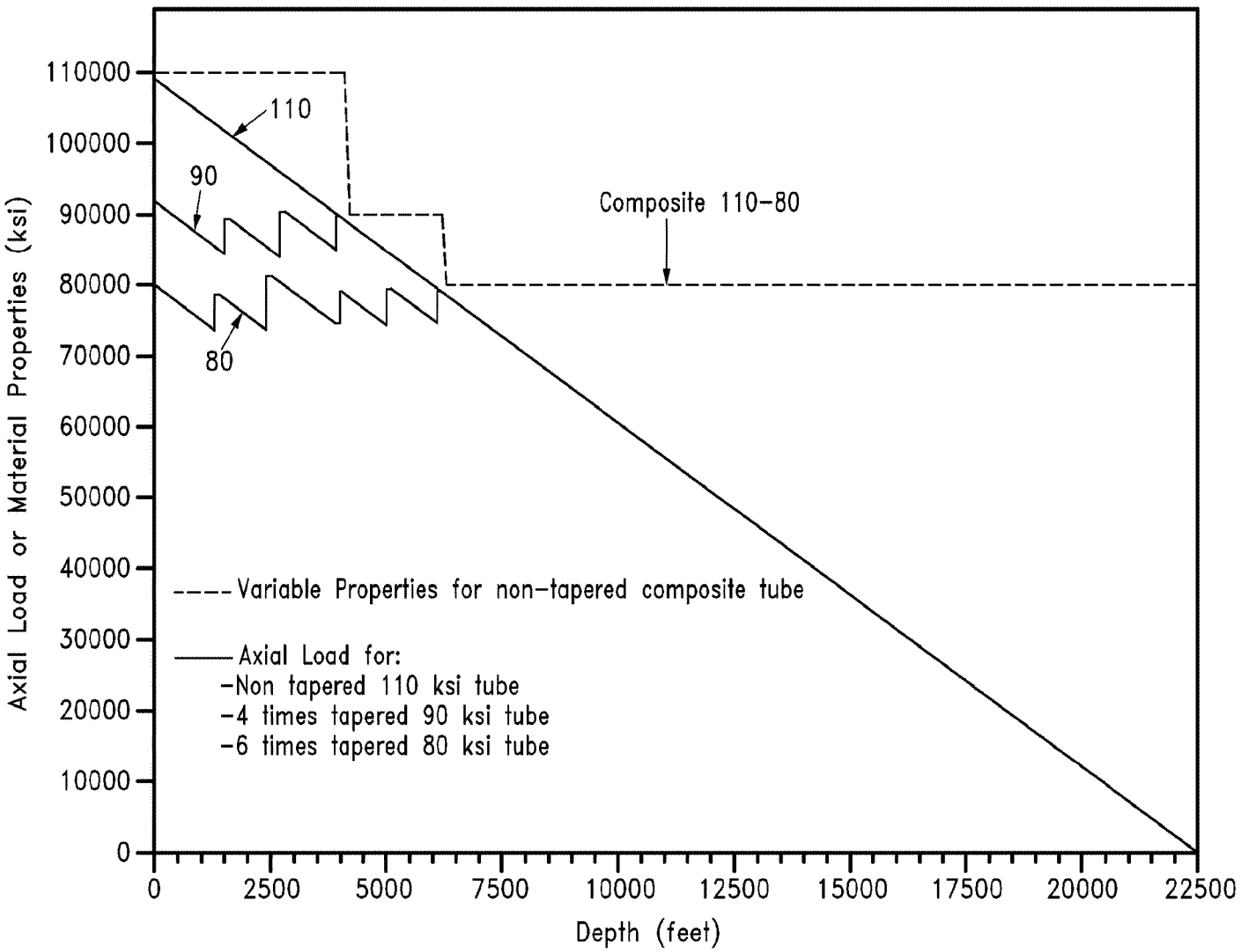
FIG. 6 is a plot of an example of required mechanical properties for a coiled tube as a function of depth from a well surface (0 ft) to a bottom of the well (22,500 ft) for a 110 ksi tube without being tapered, a four tapered 90 ksi tube, and a six tapered 80 ksi tube; also the dashed line shows mechanical properties for an embodiment of a composite tube without being tapered.

The density value was estimated as the density of iron of about 0.283 $lb/in^3$. This indicates that if the tube is designed to have a yield strength of 110 ksi, the cross section at the top of the well will be capable of withstanding the weight of the coiled tube. If the same coiled tube is produced with material having a SMYS of 90 or 80 ksi, it may be necessary to taper the upper length of the coiled tube in order to increase the resistance area "A" (e.g. the wall thickness of the coiled tube is increased in the section closer to the well surface compared to the section of the coiled tube closer to the well bottom. FIG. 6 shows a full line (see the solid lines in FIG. 6) of the required mechanical properties from the bottom of the well (22,500 ft) to the well surface (0 ft) for a 110, 90 and 80 ksi coiled tube. As illustrated in FIG. 6, by performing wall thickness changes (e.g. tapers) (which are generally restricted to a number of standard thicknesses produced by the steel rolling mill), the resulting tapered coiled tube could be built with 110, 90 or 80 ksi material (when the whole coiled tube is manufactured in only one type of material).

If a composite coiled tube is defined with the properties varying as indicated by the dotted line in FIG. 6, the well could be serviced since the properties vary to improve the overall performance of the coiled tube as indicated in Table II below. The estimation of relative fatigue life and pumping pressure (calculated relative to the composite coiled tube) in Table II is defined based on models used for prediction of service life and current standards. For example, as illustrated in FIG. 6, the tube can have a yield strength of at least 110 ksi to a depth of about 4,000 feet, a yield strength of at least 90 ksi to a depth of about 6,500 feet and a yield strength of at least 80 ksi at depths greater than about 6,500 feet.

TABLE II

| Example | # of taper changes | # of weld joints | Internal Flash Removal (Y/N) | Relative weight | Relative pumping pressure | Relative fatigue life | SSC resistance | Cost |
|---|---|---|---|---|---|---|---|---|
| 110 ksi coiled tube | 0 | 9 | Y | 100.0% | 100.0% | 80.0% | Worst | Highest |
| 90 ksi coiled tube | 4 | 11 | N | 103.1% | 102.8% | 53.3% | Medium | Medium |
| 80 ksi coiled tube | 7 | 12 | N | 107.5% | 107.5% | 48.9% | Best | Medium |
| Composite coiled tube | 0 | 9 | Y | 100.0% | 100.0% | 100.0% | Best | Lowest |

Internal flash removal refers to the elimination of the material that is expulsed from the weld during the ERW process. This material can only be removed if the taper changes are reduced to zero (e.g. taper changes can restrict or prevent the removal of flash). The presence of the flash can affect the fatigue life as well as the ability to inspect the tube.

The best coiled tube is the composite coiled tube because, while keeping the number of taper changes to zero and the tube weight to a minimum, it has lower mechanical properties down the coiled tube, improving the fatigue life as well as the resistance to embrittlement in $H_2S$ environments by SSC. Furthermore, the cost of the raw material for the composite coiled tube can be lower. An "all 80 ksi" coiled tube will have similar resistance to SSC but with 7.5% weight increase, while and "all 110 ksi" material will have similar weight and no taper changes but lower fatigue and SSC resistance.

In addition, the number of weld joints between tube sections can be minimized. As shown in Table II, the number of tube sections was higher for 90 ksi coiled tube and 80 ksi coiled tube because of the wall thickness changes (e.g., tapers). The additional tapers can reduce the fatigue resistance of the tube. In certain embodiments, the average length of the tube sections is greater than 2500 feet along the entire length of the tube. In further embodiments, the average length of tube sections is greater than if there were taper changes in the tube.

The composite coiled tube, by minimizing the number of tapers, also increases the coiled tube capacity and volume, as well as reliability of inspection, using a drift ball for example. The internal flash removal with no tapers is also possible if desired.

For a tapered coiled tube, the increased wall thickness reduces the inner diameter and results in higher pumping pressure for the same volumetric flow rate. Higher pumping pressure will both increase the energy required for pumping and reduce the fatigue life by increasing internal stresses. Therefore, the composite product described herein can have optimized properties and improved properties over a tapered coiled tube.

Pumping pressure can be a function of tube length and inside diameter, and pumping pressure can be calculated using well-known fluid mechanics relationships. Therefore, by increasing the inside diameter of the tube, the pumping pressure can be reduced for a certain flow rate. Furthermore, fatigue life can be affected by many factors including the tube yield strength, the internal pressure, and others. The example tubes described herein can have improved fatigue life by having a combined effect of selecting yield strength, decreasing internal pressure (e.g., pumping pressure), and decreasing number of strip to strip welds. SSC resistance can be assessed in accordance with NACE TM0177 and NACE MR0175. One strong correlation in C—Mn steels is the relationship between hardness and SSC resistance. As previously discussed, in general, steel with a higher hardness results in lower SSC resistance. Also in general, steel with a higher strength has a higher hardness which results in a lower SSC resistance. The composite coiled tube can have lower strength tube confined to the lower part of the coiled tube where the SSC exposure is higher. Furthermore, the composite coiled tube can have high strength tube confined to the upper part of the coiled tube where the SSC exposure is less.

The properties after a heat treatment are affected by the time and temperature history of the material, making the process subject to validation. The validation process is supported by metallurgical models that allows for the correct prediction of tube properties at each section of the coiled tube. In the certain conventional coiled tubes, the properties along the length of the coiled tube depend on hot rolled schedule at the steel supplier, sequence of coil splicing (since not all coils are equal), as well as the cold forming process at tube mill. The composite heat treated coiled tube is much more reliable than the standard coiled tube. For example, the properties of the composite heat treated coiled tube can be more consistent since the properties primarily depend on the heat treatment process while conventional coiled tubes have many variables that result in large variations in properties between sections of the coiled tube and also between different coiled tubes.

This example is just one possible method of heat treating a coiled tube to maximize the performance of the coiled tube. Customers may have other needs and other methods can be designed to produce a tailor made coiled tube to a customer's needs. How to design a heat treatment profile to produce a particular coiled tube should be apparent from the above example and further description herein.

Example 3

In another example, the coiled tube is produced by hot rolling a coiled tube of a different starting outer diameter (OD) (e.g., by using a standard hotstretch reducing mill that is fed by a starting coiled tube with different OD and wall thickness than the exiting coiled tube). The properties of the starting coiled tube are defined by the thermo mechanical control rolling process (TMCP) at the hot rolling mill and the subsequent cold working at the tube mill. During the coiled tube hot rolling process, the properties decrease since the hot rolling milling of the tube could not reproduce the TMCP. The continuous heat treatment process could be used to generate new properties on the coiled tube, and in particular, to vary the properties in order to improve the overall performance of the coiled tube. These property variations could not be generated during the hot rolling since the property changes are affected by the degree of reduction during rolling.

Example 4

During hot rolling, the final properties are affected by the schedule of reduction at the hot rolling mill as well as the cooling at the run out table and final coiling process. Since the water in the run out table could generate differing cooling patterns across the width of the hot rolled coil, a faster cooling on coil edges and variations along the length due to "hot lead end practices" to facilitate coiling, as well as differential cooling of the inside of the coil with respect to the ends, the properties of the tubes would inherit these variations. In the case of the heat treated coiled tubes, the variation of properties are mainly affected by the chemistry and hence occur at a heat level (e.g., a heat size is the size of the ladle in the steelmaking process and hence is the maximum volume with same chemistry produced by a batch steelmaking process). The variation of properties of the composite heat treated coiled tube could be under control by having improved control of the heat treatment (heating, soaking, cooling, etc. (e.g., rate and time)) along the length of the coiled tube.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion.

What is claimed is:

1. A method of forming and heat treating a coiled tube, the method comprising:

providing a plurality of steel strips to be welded together, each of the steel strips including from about 0.010 wt. % to about 0.025 wt. % titanium and from about 0.0010 wt. % to about 0.0025 wt. % of boron;

welding the plurality of steel strips together end-to-end to form a plurality of end-to-end welded strips and longitudinally welding the plurality of end-to-end welded strips to form a tube comprising:

a first tube section with a substantially constant inner diameter, outer diameter, and wall thickness; and a second tube section with a wall thickness that is different than the wall thickness of the first tube section;

after forming the tube, performing a continuous and dynamic heat treatment (CDHT) process comprising a continuous quench and temper heat treatment along the tube, wherein heating rate is modified to compensate for the change in wall thickness from the first tube section to the second tube section, thereby resulting in a tube with substantially uniform microstructure comprising at least 80% tempered martensite across (a) the plurality of steel strips, (b) the plurality of end-to-end welds joining the steel strips, and (c) the plurality of longitudinal welds joining the plurality of end-to-end welded steel strips; and coiling the first portion of coiled tubing to form a coiled tube.

2. The method of claim 1, wherein the step of coiling the first portion of coiled tubing to form a coiled tube comprises coiling the first portion of coiled tubing on a spool.

3. The method of claim 1, further comprising:

after forming the first portion of coiled tubing, coiling the first portion of coiled tubing on a spool;

uncoiling the first portion of coiled tubing from the spool prior to performing the CDHT process;

performing the CDHT process; and after performing the CDHT process, re-coiling the first portion of coiled tubing.

4. The method of claim 1, wherein the plurality of steel strips have a substantially uniform steel composition.

5. The method of claim 1, wherein the first portion of coiled tubing has a tempered martensite microstructure along substantially its entire length.

6. The method of claim 1, wherein performing the continuous quench and temper heat treatment comprises translating the first portion of coiled tubing through a heat treatment system that performs heating action, cooling action, or both.

7. The method of claim 6, wherein translating the first portion of coiled tubing is at variable speeds.

8. The method of claim 1, wherein performing the continuous quench and temper heat treatment comprises at least one quenching operation, intermediate operation, and tempering operation.

9. The method of claim 1, wherein at least one parameter of the continuous quench and temper heat treatment is selected from a group consisting of temperature, soak time, heating rate, and cooling rate.

10. The method of claim 1, wherein at least one parameter of the continuous quench and temper heat treatment is selected from a group consisting of at least two of temperature, soak time, heating rate, and cooling rate.

11. The method of claim 1, wherein a yield strength of the first portion of coiled tubing is between 80 ksi and 140 ksi.

12. The method of claim 1, wherein the step of providing a plurality of steel strips to be welded together, comprises each of the steel strips including from about 1.30 wt. % to about 1.50 wt. % manganese.

13. The method of claim 1, further comprises providing a plurality of steel strips to be welded together, each of the plurality of steel strips including from about 0.15 wt. % to about 0.35 wt. % silicon.

14. The method of claim 1, further comprises providing a plurality of steel strips to be welded together, each of the plurality of steel strips including less than about 0.005 wt. % sulfur.

15. The method of claim 1, further comprises providing a plurality of steel strips to be welded together, each of the plurality of steel strips including from about 0.015 wt. % to about 0.070 wt. % aluminum.

16. The method of claim 1, further comprises providing a plurality of steel strips to be welded together, each of the plurality of steel strips including less than about 0.020 wt. % phosphorus.

17. The method of claim 1, further comprises providing a plurality of steel strips to be welded together, each of the steel strips including from about 0.15 wt. % to about 0.35 wt. % chromium.

18. The method of claim 17, further comprises providing a plurality of steel strips to be welded together, each of the steel strips including from about 1.20 wt. % to about 1.60 wt. % manganese.

19. The method of claim 17, further comprises providing a plurality of steel strips to be welded together, each of the plurality of steel strips including from about 0.15 wt. % to about 0.35 wt. % silicon.

20. The method of claim 17, further comprises providing a plurality of steel strips to be welded together, each of the plurality of steel strips including less than about 0.005 wt. % sulfur.

21. The method of claim 17, further comprises providing a plurality of steel strips to be welded together, each of the plurality of steel strips including from about 0.015 wt. % to about 0.070 wt. % aluminum.

22. The method of claim 17, further comprises providing a plurality of steel strips to be welded together, each of the plurality of steel strips including less than about 0.020 wt. % phosphorus.

23. A method of forming and heat treating a tube, the method comprising:

providing a plurality of steel strips to be welded together, each of the steel strips including from about 0.010 wt. % to about 0.025 wt. % titanium and from about 0.0010 wt. % to about 0.0025 wt. % of boron;

welding the plurality of steel strips together end-to-end to form a plurality of end-to-end welded strips and longitudinally welding the plurality of end-to-end welded strips to form a tube having a first microstructure and comprising:

a first tube section with a substantially constant inner diameter, outer diameter, and wall thickness, said first portion of coiled tubing having a first microstructure; and a second tube section with a wall thickness that is different than the wall thickness of the first tube section;

after forming the tube, performing a continuous and dynamic heat treatment process (CDHT) comprising a continuous quench and temper heat treatment along the tube, wherein heating rate is modified to compensate for the change in wall thickness from the first tube section to the second tube section, thereby resulting in a tube with a second microstructure comprising at least 80% tempered martensite across (a) the plurality of steel strips, (b) the plurality of end-to-end welds, and (c) the plurality of longitudinal welds, wherein the second microstructure is more homogeneous than the first microstructure; and coiling the first portion of coiled tubing to form a coiled tube.

24. The method of claim 23, wherein the step of coiling the first portion of coiled tubing to form a coiled tube comprises coiling the first portion of coiled tubing on a spool.

25. The method of claim 23, further comprising:

after forming the first portion of coiled tubing, coiling the first portion of coiled tubing on a spool;

uncoiling the first portion of coiled tubing from the spool prior to performing the CDHT process;

performing the CDHT process; and after performing the CDHT process, re-coiling the first portion of coiled tubing.

26. The method of claim 23, wherein the plurality of steel strips have a substantially uniform steel.

27. The method of claim 23, wherein the first portion of coiled tubing has a tempered martensite microstructure along substantially its entire length.

28. The method of claim 23, wherein performing the continuous quench and temper heat treatment comprises translating the first portion of coiled tubing through a heat treatment system that performs heating action, cooling action, or both.

29. The method of claim 28, wherein translating the first portion of coiled tubing is at variable speeds.

30. The method of claim 23, wherein the performing a continuous quench and temper heat treatment comprises at least one quenching operation, intermediate operation, and tempering operation.

31. The method of claim 23, wherein at least one parameter of the continuous quench and temper heat treatment process is selected from a group consisting of temperature, soak time, heating rate, and cooling rate.

32. The method of claim 23, wherein at least one parameter of the continuous quench and temper heat treatment is selected from a group consisting of at least two of temperature, soak time, heating rate, and cooling rate.

33. The method of claim 23, wherein a yield strength of the first portion of coiled tubing is between 80 ksi and 140 ksi.

34. The method of claim 23, wherein the step of providing a plurality of steel strips to be welded together, comprises each of the steel strips including from about 1.30 wt. % to about 1.50 wt. % manganese.

35. The method of claim 23, further comprises providing a plurality of steel strips to be welded together, each of the plurality of steel strips including from about 0.15 wt. % to about 0.35 wt. % silicon.

36. The method of claim 23, further comprises providing a plurality of steel strips to be welded together, each of the plurality of steel strips including less than about 0.005 wt. % sulfur.

37. The method of claim 23, further comprises providing a plurality of steel strips to be welded together, each of the plurality of steel strips including from about 0.015 wt. % to about 0.070 wt. % aluminum.

38. The method of claim 23, further comprises providing a plurality of steel strips to be welded together, each of the plurality of steel strips including less than about 0.020 wt. % phosphorus.

39. The method of claim 23, further comprises providing a plurality of steel strips to be welded together, each of the steel strips including from about 0.15 wt. % to about 0.35 wt. % chromium.

40. The method of claim 39, further comprises providing a plurality of steel strips to be welded together, each of the steel strips including from about 1.20 wt. % to about 1.60 wt. % manganese.

41. The method of claim 39, further comprises providing a plurality of steel strips to be welded together, each of the plurality of steel strips including from about 0.15 wt. % to about 0.35 wt. % silicon.

42. The method of claim 39, further comprises providing a plurality of steel strips to be welded together, each of the plurality of steel strips including less than about 0.005 wt. % sulfur.

43. The method of claim 39, further comprises providing a plurality of steel strips to be welded together, each of the plurality of steel strips including from about 0.015 wt. % to about 0.070 wt. % aluminum.

44. The method of claim 39, further comprises providing a plurality of steel strips to be welded together, each of the plurality of steel strips including less than about 0.020 wt. % phosphorus.

* * * * *